US007395867B2

(12) United States Patent
McGuire et al.

(10) Patent No.: US 7,395,867 B2
(45) **Date of Patent: *Jul. 8, 2008**

(54) HYBRID WELLHEAD SYSTEM AND METHOD OF USE

(75) Inventors: Bob McGuire, Oklahoma City, OK (US); L. Murray Dallas, Fairview, TX (US)

(73) Assignee: Stinger Wellhead Protection, Inc., Oklahoma City, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/650,631

(22) Filed: Jan. 8, 2007

(65) Prior Publication Data

US 2007/0107910 A1 May 17, 2007

Related U.S. Application Data

(63) Continuation of application No. 10/802,326, filed on Mar. 17, 2004, now Pat. No. 7,159,663.

(51) Int. Cl.
*E21B 33/03* (2006.01)

(52) U.S. Cl. ..... 166/379; 166/75.14; 166/85.4; 166/89.1

(58) Field of Classification Search ..... 166/85.4, 166/89.1, 75.14, 379
See application file for complete search history.

(56) References Cited

U.S. PATENT DOCUMENTS 1,836,419 A * 12/1931 Wigle ..... 285/123.9
1,988,442 A 1/1935 Begg
3,724,501 A 4/1973 Scott
4,541,490 A 9/1985 Bibbie et al.
5,540,282 A 7/1996 Dallas
5,605,194 A 2/1997 Smith
6,220,361 B1 4/2001 Brisco
6,364,024 B1 4/2002 Dallas
6,626,245 B1 9/2003 Dallas
6,712,147 B2 3/2004 Dallas
6,817,421 B2 11/2004 Dallas
6,817,423 B2 11/2004 Dallas
7,032,677 B2 4/2006 McGuire et al.
7,040,410 B2 5/2006 McGuire et al.
7,066,269 B2 6/2006 Dallas et al.
7,159,663 B2 * 1/2007 McGuire et al. ..... 166/379

* cited by examiner

*Primary Examiner*—Hoang Dang
(74) *Attorney, Agent, or Firm*—Nelson Mullins Riley & Scarborough, LLP

(57) ABSTRACT

A hybrid wellhead system is assembled using a plurality of threaded unions, such as spanner nuts or hammer unions, for securing respective tubular heads and a flanged connection for securing a flow control stack to a top of a tubing head spool. The tubing head spool is secured by a threaded union to an intermediate head spool. The intermediate head spool is secured by another threaded union to a wellhead. Each tubular head secures and suspends a tubular string in the well bore. The hybrid wellhead system is capable of withstanding higher fluid pressures than a conventional independent screwed wellhead, while providing a more economical alternative to a flanged, or ranged, wellhead system because it is less expensive to construct and faster to assemble.

21 Claims, 20 Drawing Sheets

HYBRID WELLHEAD SYSTEM AND METHOD OF USE

CROSS-REFERENCE TO RELATED APPLICATIONS

This application is a continuation of U.S. patent application Ser. No. 10/802,326 filed Mar. 17, 2004, now U.S. Pat. No. 7,159,663 which issued Jan. 9, 2007.

MICROFICHE APPENDIX

Not Applicable.

TECHNICAL FIELD

The present invention relates generally to wellhead systems for the extraction of subterranean hydrocarbons and, in particular, to a hybrid wellhead system employing both threaded unions and flanged connections.

BACKGROUND OF THE INVENTION

Wellhead systems are used for the extraction of hydrocarbons from subterranean deposits. Wellhead systems include a wellhead and, optionally mounted thereto, various Christmas tree equipment (for example; casing and,tubing head spools, mandrels, hangers, connectors, and fittings). The various connections, joints and unions needed to assemble the components of the wellhead system are usually either threaded or flanged. As will be elaborated below, threaded unions are typically used for low-pressure wells where the working pressure is less than 3000 pounds per square inch (PSI), whereas flanged unions are used in high-pressure wells where the working pressure is expected to exceed 3000 PSI.

Independent screwed wellheads are well known in the art. The American Petroleum Institute (API) classifies a wellhead as an"independent screwed wellhead" if it possesses the features set out in API Specification 6A entitled "Specification for Wellhead and Christmas Tree Equipment." The independent screwed wellhead has independently secured heads for each tubular string supported in the well bore. The pressure within the casing is controlled by a blowout preventer (BOP) typically secured atop the wellhead. The head is said to be"independently" secured to a respective tubular string because it is not directly flanged or similarly affixed to the casing head. Independent screwed wellheads are widely used for production from low-pressure production zones because they are economical to construct and maintain. Independent screwed wellheads are typically utilized where working pressures are less than 3000 pounds per square inch (PSI). Further detail is found in U.S. Pat. No. 5,605,194 (Smith) entitled-"Independent Screwed Wellhead with High Pressure Capability and Method" which provides an apt summary of the features, uses and limitations of independent screwed wellheads.

Flanged wellheads, as noted above, are employed where working pressures are expected to exceed 3000 PSI. Wellhead systems with flanged connections are frequently designed to withstand fluid pressures of 5000 or even 10,000 PSI. The downside of flanged wellheads (also known in the art as ranged wellheads) is that they are heavy, time-consuming to assemble, and expensive to construct and maintain. As noted in U.S. Pat. No. 5,605,194 (Smith), a 5000-PSI ranged wellhead may cost two to four times that of an independent screwed wellhead with a working pressure rating of 3000 PSI. While oil and gas companies prefer to employ independent screwed wellheads rather than flanged wellheads, the latter must be used for high-pressure applications. Oil and gas companies are thus faced with a tradeoff between pressure rating and cost.

U.S. Pat. No. 5,605,194 (Smith) discloses an apparatus and method for temporarily reinforcing a low-pressure independent screwed wellhead with a high-pressure casing nipple so as to give it a high-pressure capability. The casing nipple described by Smith permits high-pressure fracturing operations to be performed through an independent screwed wellhead. Fracturing operations may achieve fluid pressures in the neighborhood of 6000 PSI, which the casing nipple is able to withstand even though the wellhead is only rated for 3000 PSI.

One of the disadvantages of the Smith casing nipple and method of use is that the casing nipple must be installed prior to fracturing and then removed prior to inserting the tubing string. As persons skilled in the art will readily appreciate, the steps of installing and removing the casing nipple generally entail killing the well, resulting in uneconomical downtime for the rig and potentially reversing beneficial effects of the fracturing operation. It is thus highly desirable to provide an apparatus and method which overcomes these problems.

There therefore exists a need for a wellhead system which withstands elevated fluid pressures and permits the extraction of subterranean hydrocarbons at less cost for the wellhead equipment.

SUMMARY OF THE INVENTION

It is therefore an object of the invention to provide a hybrid wellhead system which optimally combines the high-pressure rating of a flanged wellhead with the relative ease-of-use and low cost of an independent screwed wellhead. The hybrid wellhead is easier and more economical to manufacture and assemble, minimizes rig downtime, and is nonetheless able to withstand high fluid pressures (e.g., at least 5000 PSI).

The hybrid wellhead system is capable of withstanding elevated fluid pressures when subterranean hydrocarbon formations are stimulated in a well. The hybrid wellhead system has a plurality of tubular heads, each tubular head suspending a respective tubular string in the well, the tubular heads being connected to the hybrid wellhead system by threaded unions; and a tubing head spool mounted to the wellhead system having a top end that is flanged for connection to a flow-control stack.

The invention further provides a method of installing a wellhead for stimulating a well for the extraction of hydrocarbons therefrom, where the pressure may spike above a working pressure rating of an independent screwed wellhead, the method comprising the steps of: securing each successive tubular head to the wellhead using a threaded union; and securing a flow-control stack to the wellhead using a flanged connection.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF PREFERRED EMBODIMENTS

For the purposes of this specification, the expressions "wellhead system", "tubular head", "tubular string", "mandrel", and "threaded union" shall be construed in accordance with the definitions set forth in this paragraph. The expression "wellhead system" shall denote a wellhead (also known as a "casing head" or "surface casing head") mounted atop a conductor assembly which is dug into the ground and which has, optionally mounted thereto, various Christmas tree equipment (for example, casing head housings, casing and tubing head spools, mandrels, hangers, connectors, and fittings). The wellhead system may also be referred to as a"stack" or as a"wellhead-stack assembly". The expression"tubular head" shall denote a wellhead body such as a tubing head spool used to support a tubing mandrel, intermediate head spool (also known as a"B Section") or a wellhead (also known as a casing head). The expression "tubular string" shall denote any casing or tubing, such as surface casing, intermediate casing, production casing or production tubing. The expression"mandrel" shall denote any generally annular mandrel body such as a production casing mandrel, intermediate casing mandrel or a tubing hanger (also known as a tubing mandrel or production tubing mandrel). The expression"threaded union" shall denote any threaded connection such as a nut, sometimes also referred to as a wing-nut, spanner nut, or hammer unions.

Prior to boring a hole into the earth for the extraction of subterranean hydrocarbons such as oil or natural gas, it is first necessary to"build the location" which involves removing any soil, sand, clay or gravel to the bedrock. Once the location is "built", the next step is to "dig the cellar" which entails digging down approximately 40-60 feet, depending on bedrock conditions. The "cellar" is also known colloquially by persons skilled in the art as the "rat hole".

Figure 1:
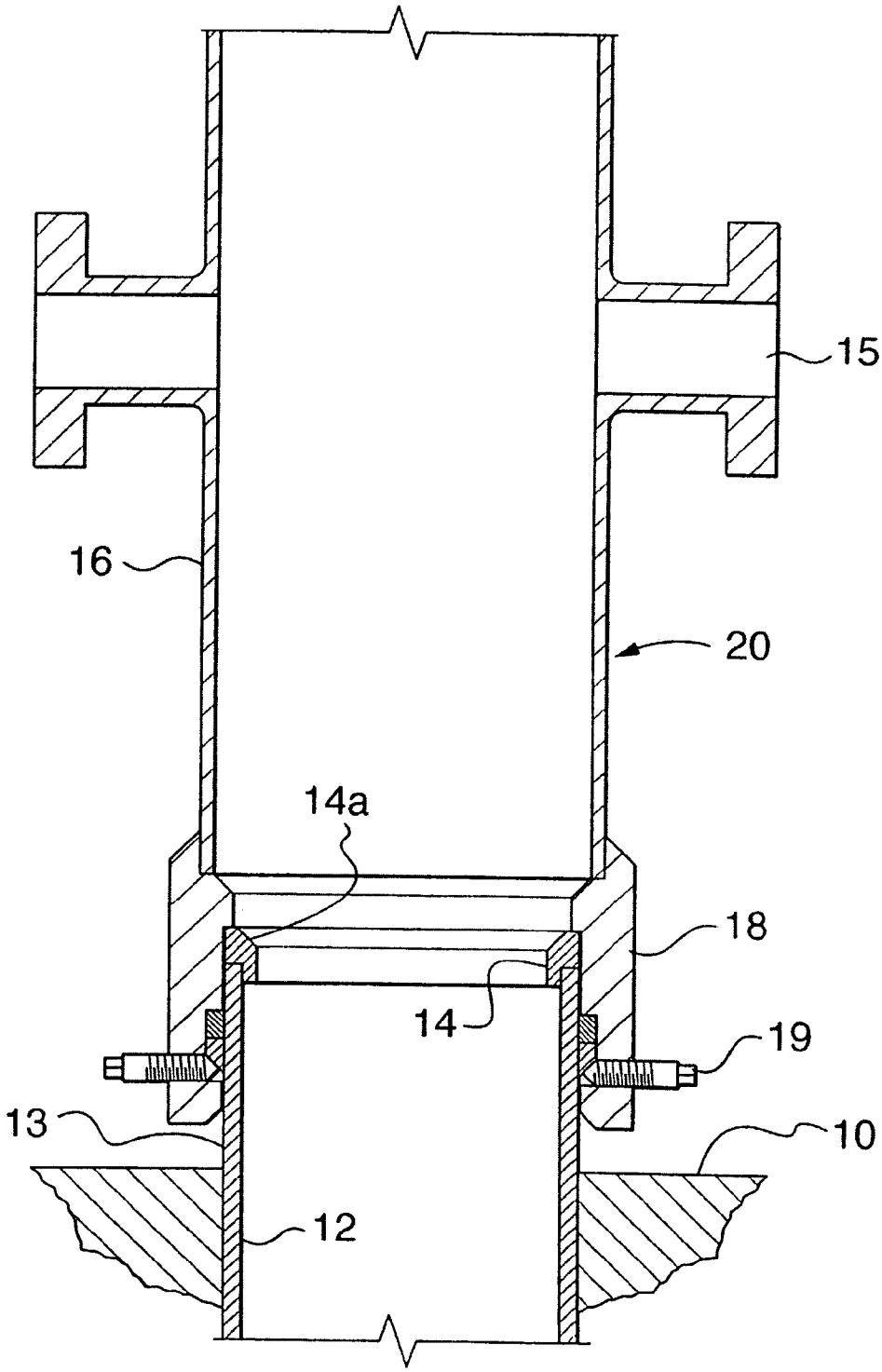
FIG. 1 is a cross-sectional elevation view of a conductor assembly having a conductor window fastened with a quick-connector to a conductor pipe that is, in turn, dug into the ground.

As illustrated in FIG. 1, a conductor 12 is inserted (or, in the jargon,"stuffed") into the rat-hole that is dug into the ground or bedrock 10. The upper portion of the conductor 12 that protrudes above ground level is referred to as a"conductor nipple" 13. A conductor ring 14 (also known as a conductor bushing) is fitted atop the upper lip of the conductor nipple 13. The conductor ring 14 has an upper beveled surface defining a conductor bowl 14*a*.

A conductor window 16, which has discharge ports 15, is connected to the conductor nipple 13 via a conductor pipe quick connector 18, which uses locking pins 19 to fasten the conductor window 16 to the conductor nipple 13. When fully assembled, the conductor window 16, the conductor ring 14 and the conductor 12 constitute a conductor assembly 20. At this point, a drill string (not shown, but well known in the art) is introduced to bore a hole that is typically 600-800 feet deep with a diameter large enough to accommodate a surface casing.

Figure 2:
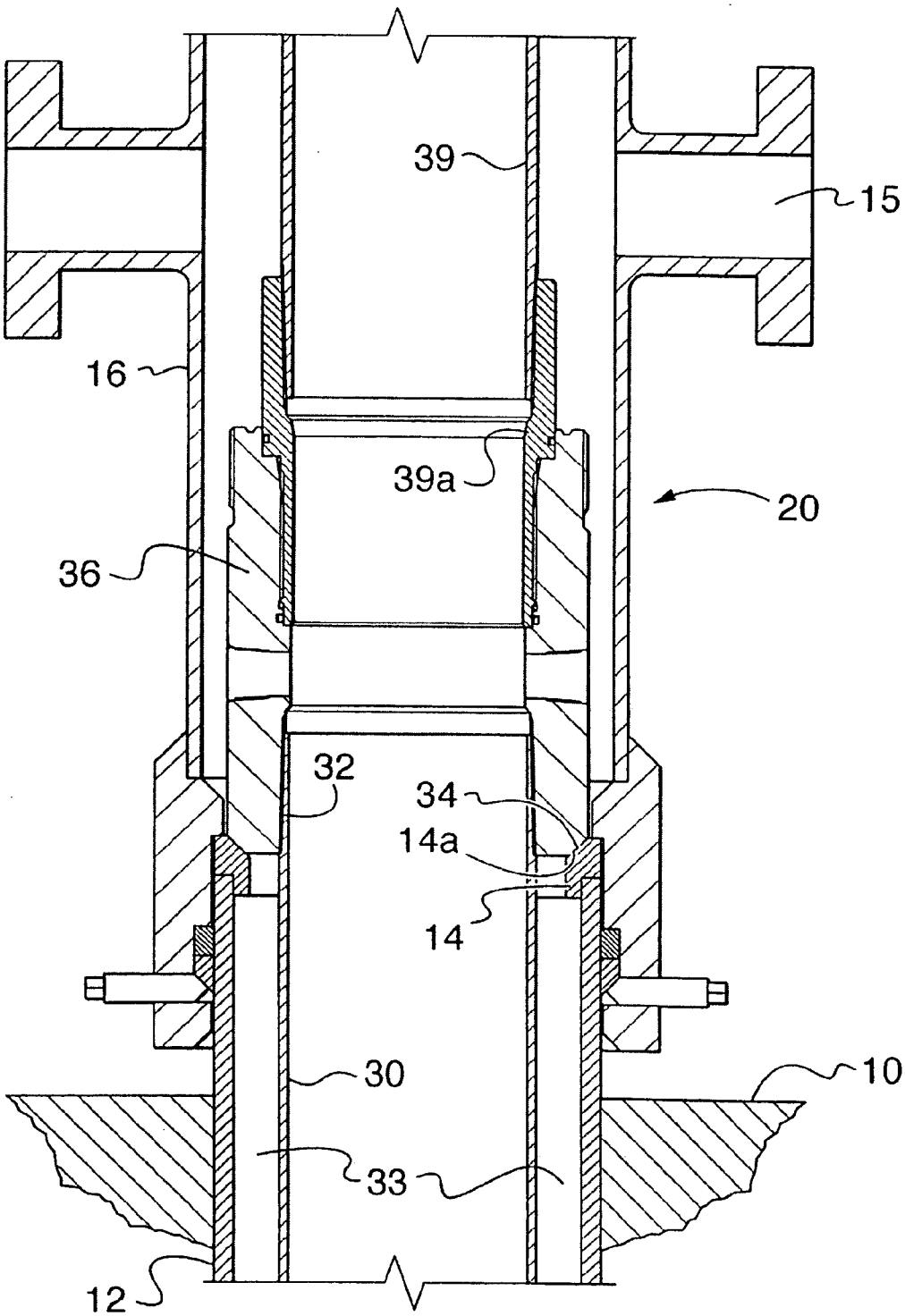
FIG. 2 is a cross-sectional elevation view of the conductor assembly shown in FIG. 1 after a surface casing has been run in and a wellhead has been landed onto a conductor bushing.

As depicted in FIG. 2, after drilling is complete, a surface casing 30 is inserted, or"run", through the conductor assembly 20 and into the bore. The surface casing 30 is connected by threads 32 at an upper end to a wellhead 36 in accordance with the invention. The wellhead 36 has a bottom end 34 shaped to rest against the conductor bowl 14*a*. The surface casing 30 is run into the bore until the bottom end 34 of the wellhead contacts the conductor bowl 14*a*, as illustrated in FIG. 2.

As shown in FIG. 2, the surface casing 30 is a tubular string having an outer diameter less than the inner diameter of the conductor 12, thereby defining an annular space 33 between the conductor and the surface casing. The annular space 33 serves as a passageway for the outflow of mud when the surface casing is cemented in, a step that is well known in the art. Mud flows back up through the annular space 33 and out the discharge ports 15 located in the conductor window 16. The annular space 33 is eventually filled up with cement during the cementing stage so as to set the surface casing in place.

Figure 3:
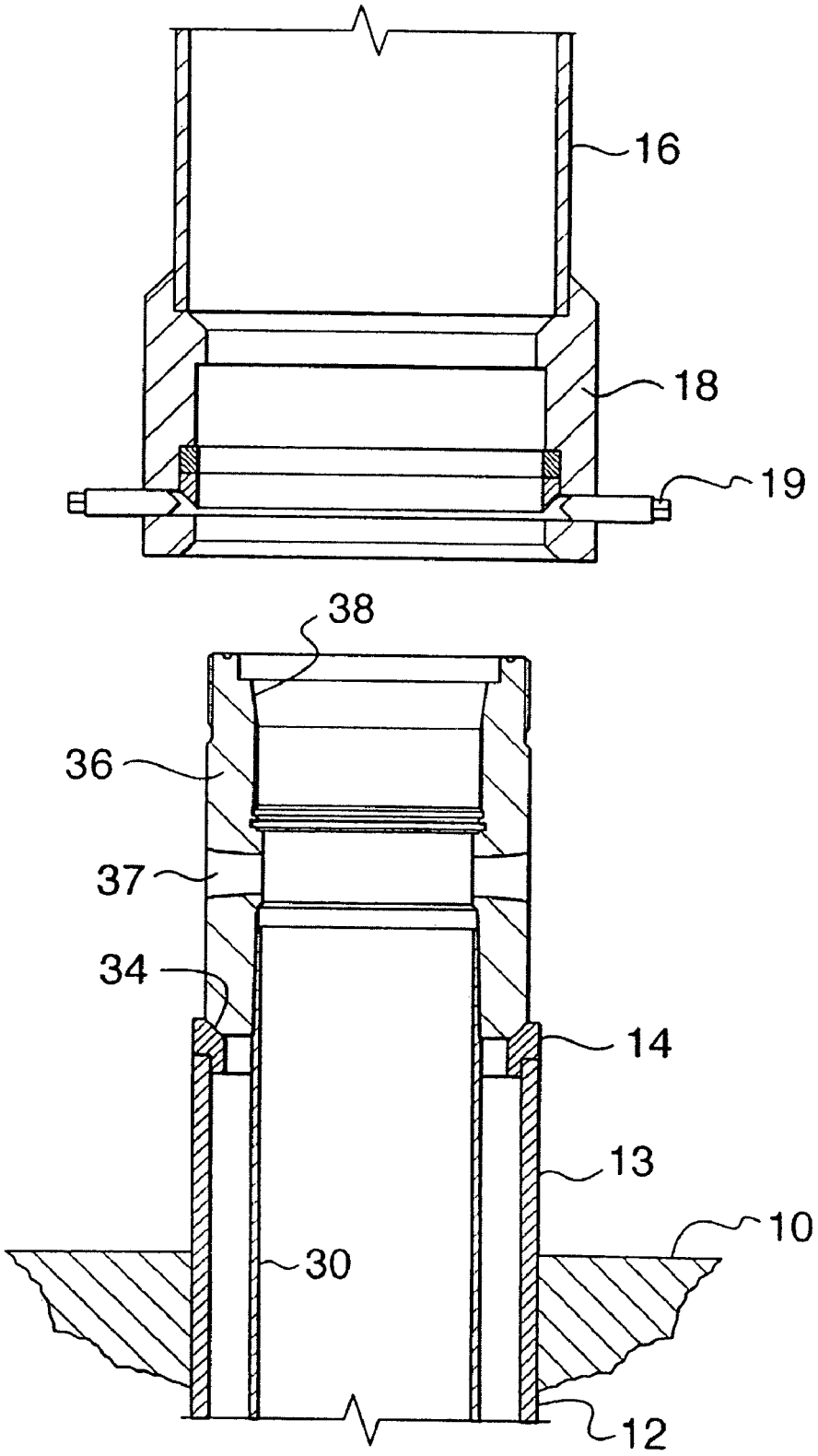
FIG. 3 is a cross-sectional elevation view illustrating the removal of the conductor window, leaving behind the exposed wellhead.

A wellhead 36 (also known as a"surface casing head") in accordance with the invention is connected to the surface casing 30 by threads 32 to constitute a wellhead-surface casing assembly. The wellhead 36 has side ports 37 (also known as flow-back ports) for discharging mud during subsequent cementing operations (which will be explained below). As illustrated in FIG. 3, the wellhead 36 also has a casing bowl 38, which is an upwardly flared bowl-shaped portion that is configured to receive a casing mandrel, as will be further explained below. As illustrated in FIG. 2, the wellhead 36 is connected by threads to a landing tool 39 via a landing tool adapter 39*a*. The landing tool 39 is used to insert the wellhead-surface casing assembly and to guide this assembly down into the bore until the wellhead contacts the conductor bowl. The casing bowl 38 of the wellhead 36 is set as soon as cementing is complete (to minimize rig down time). Once the surface casing 30 is properly cemented into place, the landing tool 39 and landing tool adapter 39*a* is unscrewed from the wellhead 36 and removed.

As depicted in FIG. 3, the conductor window 16 is then detached from the conductor 12 by disengaging the locking pins 19 of the quick connector 18. After the conductor window 16 has been removed, as shown, what remains is the wellhead-surface casing assembly, i.e., the wellhead 36 sitting atop the conductor ring 14 and the conductor 12 with the surface casing 30 suspended from the wellhead.

Figure 4:
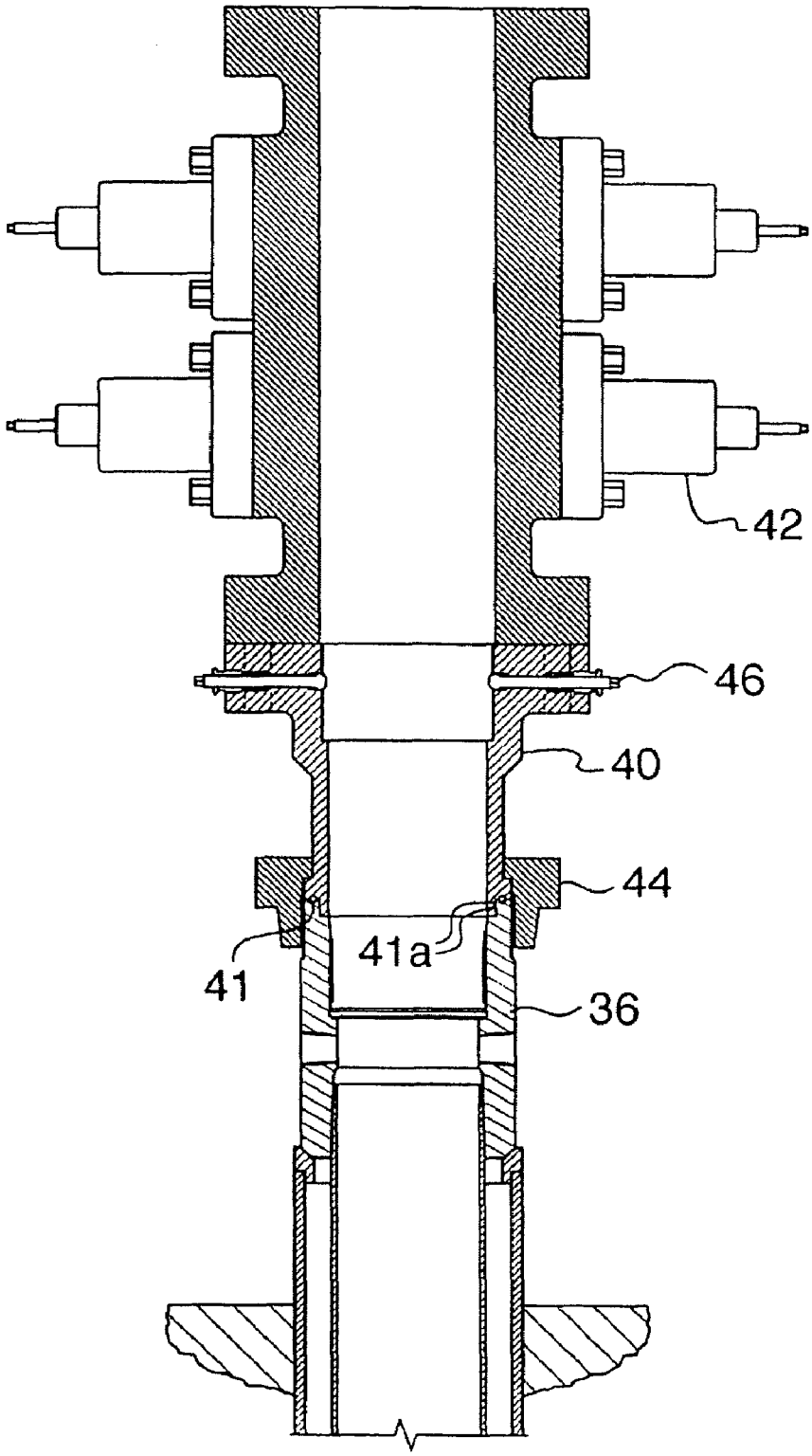
FIG. 4 is a cross-sectional elevational view showing a drilling flange and a blowout preventer secured to the wellhead by a threaded union.

FIG. 4 depicts a drilling flange 40 in accordance with the invention, and a blowout preventer 42, together constituting a pressure-control stack, secured to the wellhead 36 by a threaded union 44, such as a lockdown nut or hammer union. The drilling flange 40 and blowout preventer 42 can be installed while waiting for the cement to set, further reducing rig down time. The wellhead 36 has upper pin threads for engaging box threads of the threaded union 44. The blowout preventer (BOP) is secured to the top surface of the drilling flange 40 with a flanged connection. A metal ring gasket 41 is compressed between the drilling flange 40 and the wellhead 36 to provide a fluid-tight seal. The metal ring gasket is described in detail in the applicant's co-pending U.S. patent application Ser. No. 10/690,142 filed Oct. 21, 2003, the specification of which is incorporated herein by reference. The ring gasket ensures a fire-resistant, high-pressure seal. The drilling flange 40 also optionally has two annular grooves 41*a* in which O-rings are seated for providing a backup seal between the wellhead and the drilling flange.

The drilling flange 40 further includes locking pins 46 which are located in transverse bores in the drilling flange 40, and which are used to lock in place plugs and bushings as will be described below in more detail. The drilling flange 40 and blowout preventer 42 are mounted to the wellhead 36 in order to drill a deep bore into or adjacent to one or more subterranean hydrocarbon formation(s). But before drilling can be safely commenced, the pressure-integrity of the wellhead system, or"stack", should be tested.

Figure 5:
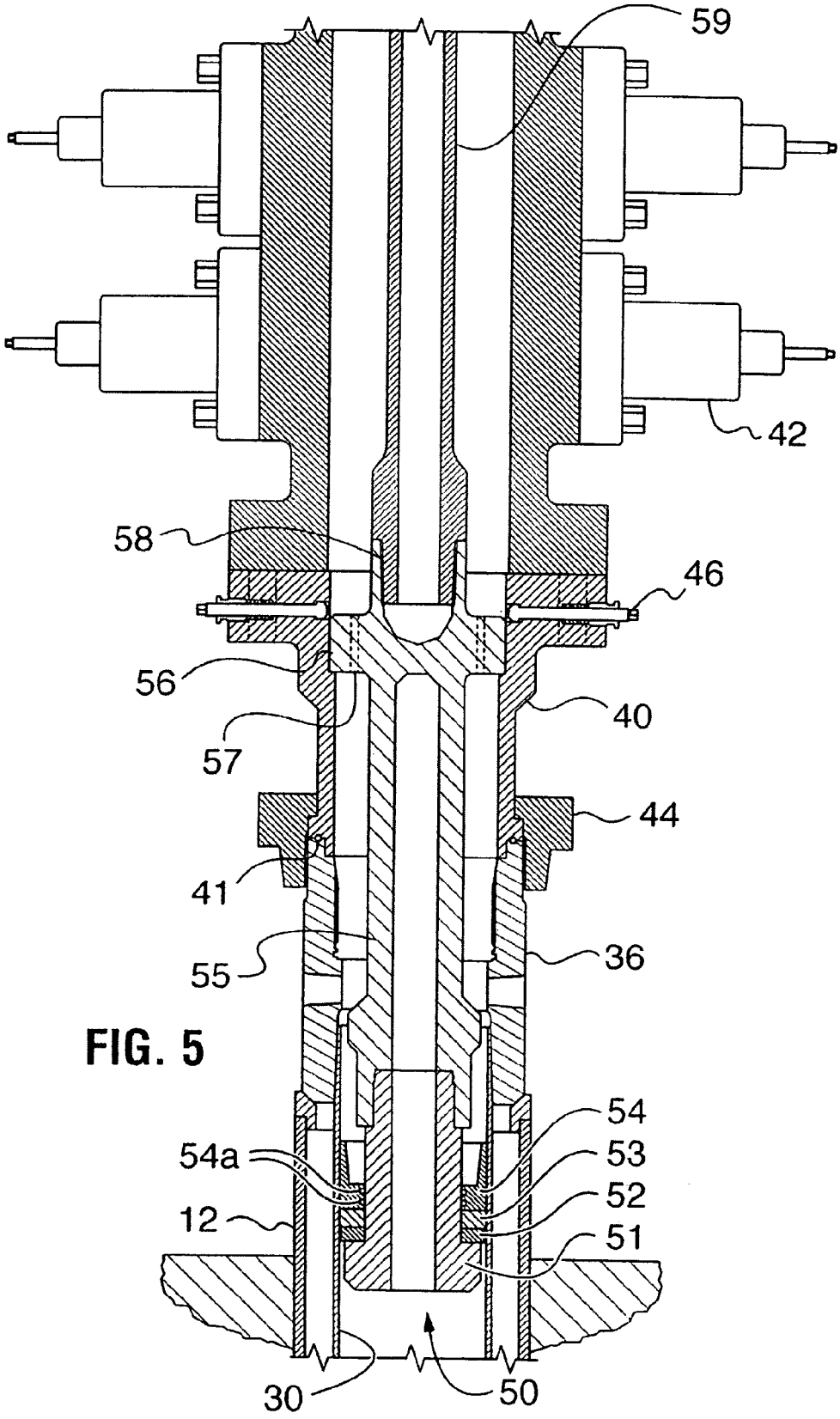
FIG. 5 is a cross-sectional elevation view of a test plug locked into place by locking pins in the drilling flange prior to retraction of the landing tool.

FIG. 5 illustrates the insertion of a test plug 50 in accordance with the invention for use in testing the pressure-integrity of the stack. The pressure-integrity testing is effected by plugging the stack with the test plug 50, closing all valves and ports (including a set of pipe rams and blinds rams on the BOP) and then pressurizing the stack. The test plug is described in detail in Applicant's co-pending U.S. patent application.

As illustrated in FIG. 5, the test plug 50 has a bull-nosed bottom portion 51 which has an annular shoulder for supporting above it a metal gauge ring 52, an elastomeric backup seal 53 and an elastomeric cup 54, which is preferably made of nitrile rubber, although other elastomers or polymers may be used. The cup 54 includes a pair of annular grooves 54*a* into which O-rings may be seated to provide a fluid-tight seal between the cup 54 and the bull-nosed bottom portion 51. The test plug 50 further includes a tubular extension 55 which is threaded at a bottom end to support the bull-nosed end portion 51. A top end of the tubular extension 55 is integrally formed with an upper shoulder 56. The upper shoulder 56 abuts an annular constriction in the drilling flange 40 as shown in FIG. 5. When the upper shoulder 56 has abutted the annular constriction, the locking pins 46 in the drilling flange 40 are screwed inwardly to engage an upper surface of the upper shoulder 56, thereby securing the test plug inside the stack. The upper shoulder 56 further includes a plurality of fluid passages 57 through which fluid may flow during pressurization of the stack.

The test plug 50 is inserted and retracted using a test plug landing tool 59 which is threaded to the test plug 50 inside an internally threaded socket 58, which extends upwardly from the upper shoulder 56. After the test plug landing tool 59 has been removed, the stack is pressurized to an estimated operating pressure. Due to the design of the test plug 50, the pressure-integrity of the joint between the wellhead and the surface casing is tested, as well as the pressure-integrity of all the joints and seals in the stack above the wellhead.

A typical test procedure begins with shutting the BOP pipe rams for testing of the pipe rams to at least the estimated operating pressure. The test plug 50 is then locked with the locking pins 46 and the landing tool 59 is removed. The BOP blind rams are then shut and tested to at least the estimated operating pressure. If all seals and joints are observed to withstand the test pressure, the test plug can be removed to make way for the drill string.

Figure 6:
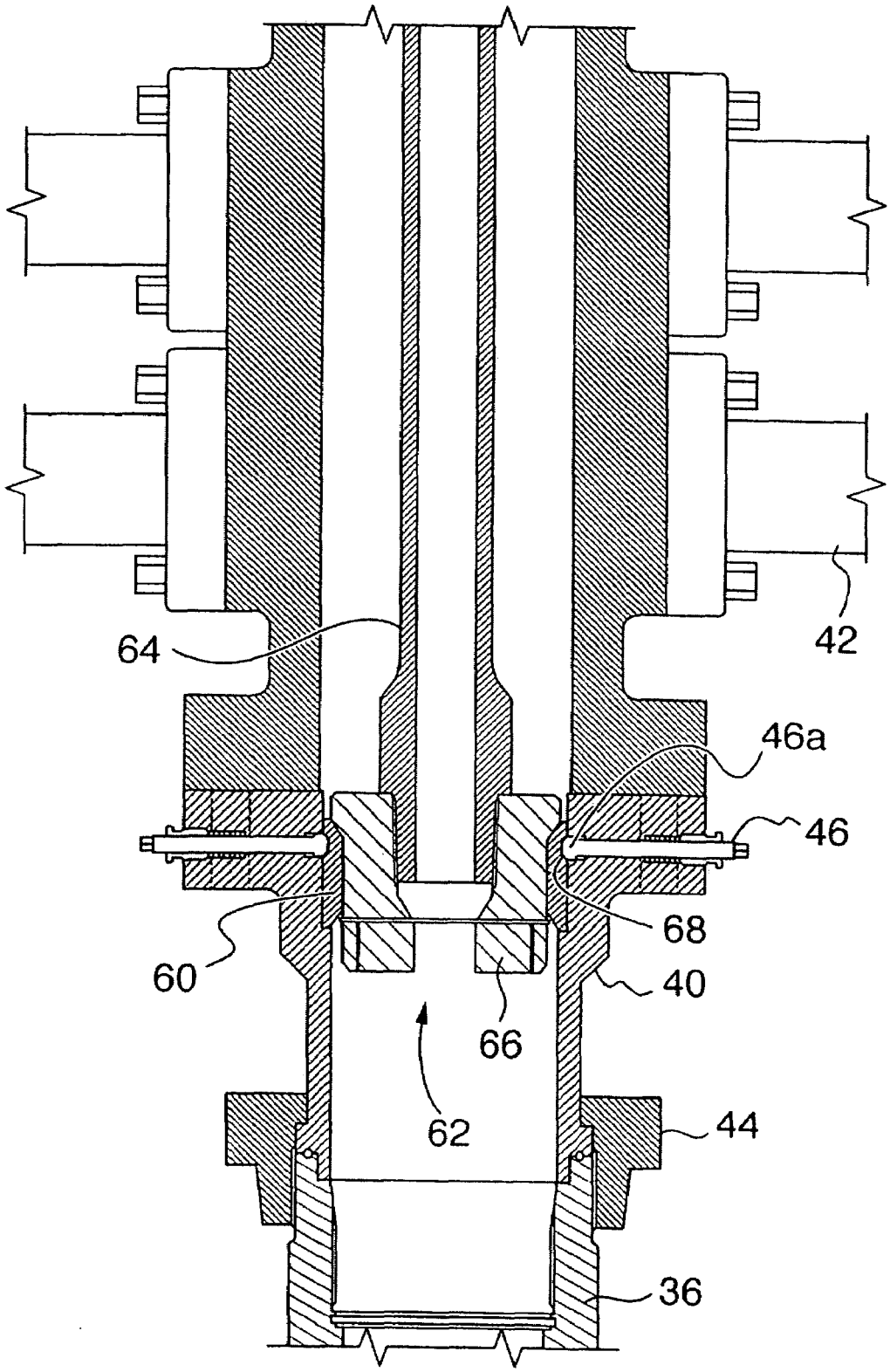
FIG. 6 is a cross-sectional elevational view illustrating a drill bushing locked in place inside the drilling flange.

As shown in FIG. 6, after the pressure-integrity of the stack is confirmed, preparations for drilling are commenced. This involves the insertion of a wear bushing 60 using a wear bushing insertion tool 62. The wear bushing insertion tool 62 includes a landing joint 64 which is used to insert the wear bushing 60 to the correct location inside the drilling flange 40. The wear bushing insertion tool 62 also includes a bushing holder 66 threadedly connected to a bottom end of the landing joint 64 for holding the wear bushing 60. The wear bushing 60 is landed in the drilling flange 40, and is then locked in place by the locking pins 46. A head 46*a* of each locking pin 46 engages an annular groove 68 in the wear bushing, thereby locking the wear bushing 60 in place.

Once the wear bushing 60 is locked in place, the wear bushing insertion tool 62 is retracted, leaving the wear bushing 60 locked inside the drilling flange 40. The stack is thus ready for drilling operations. A drill string (not illustrated, but well known in the art) is introduced into the stack so that it may rotate within the wear bushing. The wear bushing is installed to protect the casing bowl and surface casing from the deleterious effects of a phenomenon known in the art as"Kelley Whip". With the wear bushing in place, drilling of a bore (to the intermediate casing depth) may be commenced.

The drilling rig runs the drilling string into the well bore and stops a safe distance above a cement plug. After an appropriate cement curing time, drilling resumes. When a desired depth for an intermediate casing is reached, the drilling string is removed from the well bore.

Figure 7:
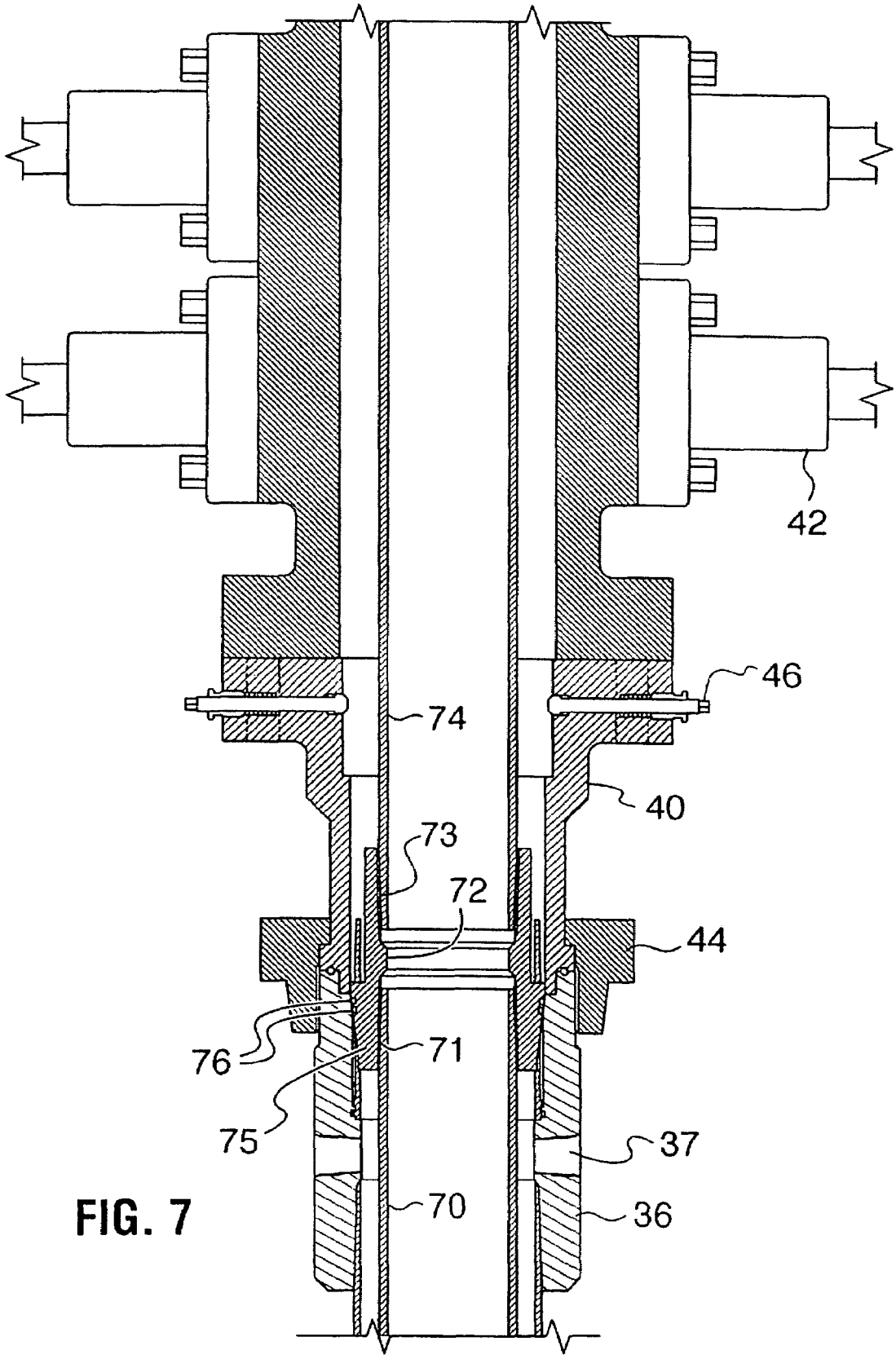
FIG. 7 is a cross-sectional elevational view of an intermediate casing being run through the stack until an intermediate casing mandrel is landed onto the wellhead.

As illustrated in FIG. 7, the intermediate casing 70 is run through the stack and into the well bore. In certain jurisdictions, industry regulations require that intermediate casing be run when exploiting a deep, high-pressure well. The intermediate casing serves to ensure that the deep production zone is isolated from porous shallower zones in the event that a production casing is ruptured.

As depicted in FIG. 7, the intermediate casing 70 is secured and suspended in the well bore by an intermediate casing mandrel 72. The intermediate casing mandrel 72 is threaded to the intermediate casing 70 at a lower threaded connection 71. The intermediate casing mandrel 72 is threaded to a landing tool 74 at an upper threaded connection 73. The intermediate casing mandrel 72 has a lower frusta-conical end 75 shaped to be seated in the casing bowl 38 of the wellhead 36. The lower frusta-conical end 75 of the intermediate casing mandrel 72 has a pair of annular grooves 76 in which O-rings are seated to provide a fluid-tight seal between the intermediate casing mandrel and the wellhead. The intermediate casing 70 is cemented into place by flowing back mud through the side ports 37 of the wellhead 36, in a manner well known in the art.

Figure 8:
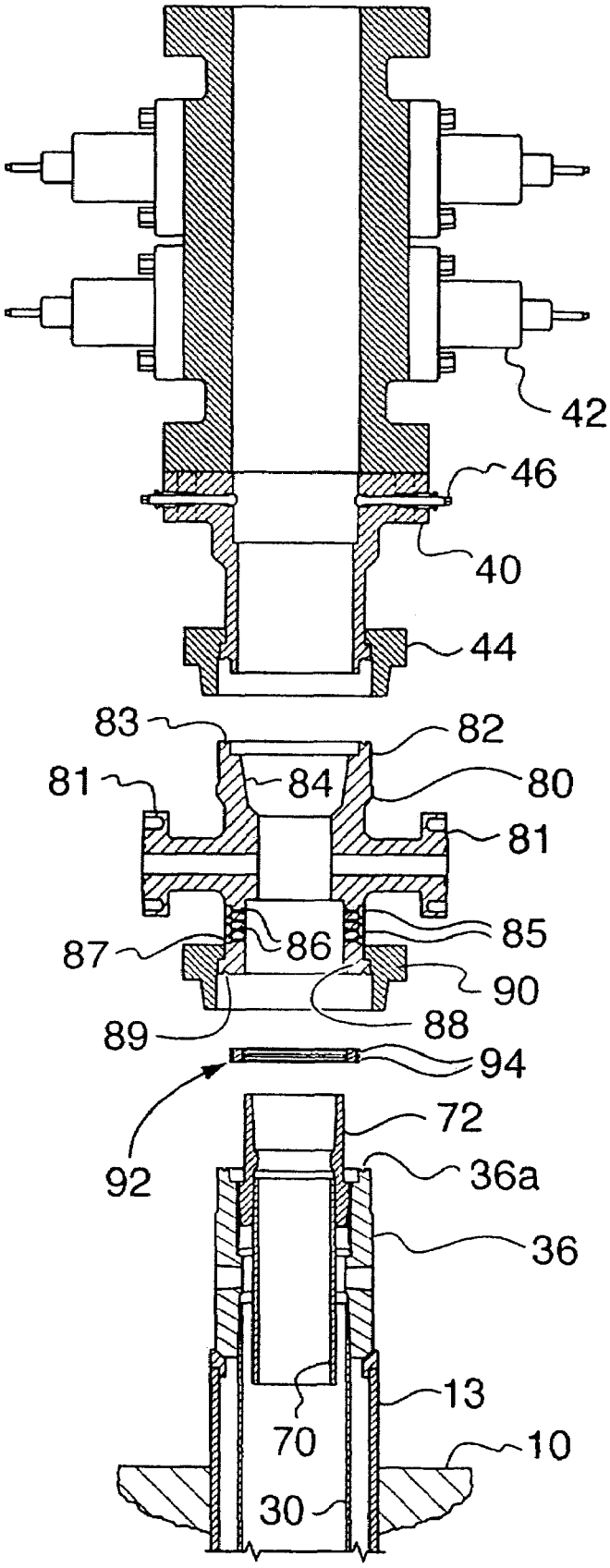
FIG. 8 is a cross-sectional elevational view illustrating the raising of the drilling flange and blowout preventer and the mounting of an intermediate head spool, or "B Section", onto the wellhead and intermediate casing mandrel.

As illustrated in FIG. 8, after the landing tool 74 is detached and removed from the intermediate casing mandrel 72, the drilling flange 40 and the blowout preventer 42 are raised to accommodate an intermediate head spool 80 in accordance with the invention. The intermediate head spool 80 is secured by threaded unions between the drilling flange 40 at the top and the wellhead 36 at the bottom.

As shown in FIG. 8, the intermediate head spool 80 has a pair of flanged side ports 81. The intermediate head spool 80 also has a set of upper pin threads 82 for engaging a set of box threads on the threaded union 44. A metal ring gasket, as described in the Applicant's co-pending application referenced above, is seated in an annular groove 83 atop the intermediate head spool 80. The drilling flange 40 is secured to the intermediate head spool 80 by the threaded union 44 which compresses the metal ring gasket between the drilling flange 40 and the intermediate head spool 80 to form a fire-resistant, high-pressure seal.

As further shown in FIG. 8, the intermediate head spool 80 also has a bowl-shaped seat 84 for seating a tubing hanger, as will be described below. Below the side ports 81, the intermediate head spool 80 has a pair of injection ports 85 for injecting plastic injection seals 86. Adjacent to the injection ports are test ports 87. The intermediate head spool 80 further includes a lower annular shoulder 88 which has an annular groove 89. The intermediate head spool 80 is secured to the wellhead 36 by a lockdown nut 90. The top surface of the wellhead 36 has an annular groove **36*a* which aligns with the annular groove 89 in the bottom surface of the intermediate head spool 80. A metal ring gasket is located in the annular grooves 36*a*, 89 and is compressed to form a fluid-tight seal when the intermediate head spool 80 is secured to the wellhead 36. Finally, as shown in FIG. 8 and FIG. 9, a seal ring 92, having four annular grooves 94 for O-rings provides a spacer and a seal beneath the intermediate head spool 80**, between the top of the wellhead and the intermediate casing mandrel.

Figure 9:
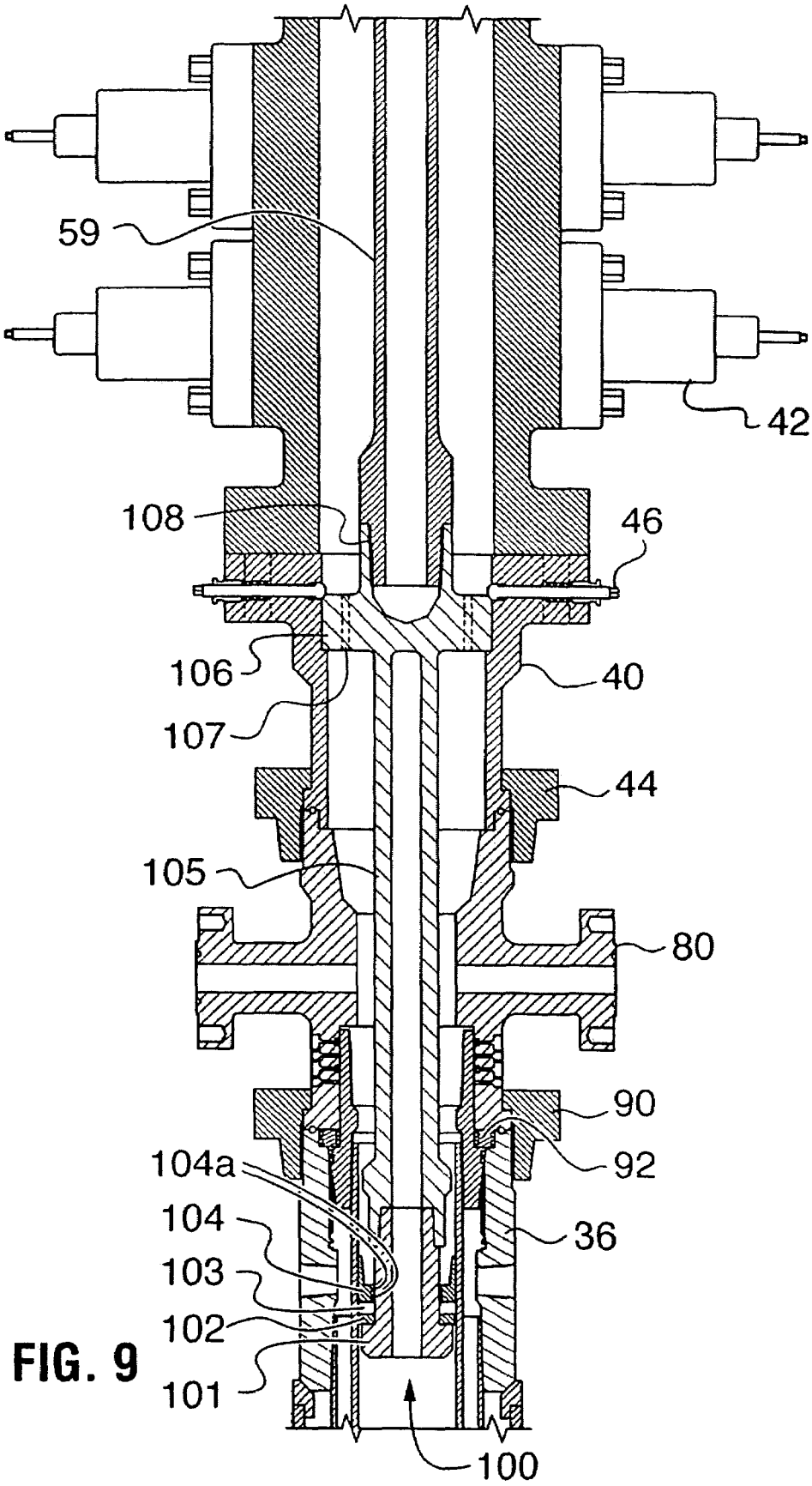
FIG. 9 is a cross-sectional elevational view showing a B Section test plug locked in place by locking pins in the drilling flange.

Illustrated in FIG. 9 is a"B Section test tool" 100 (also known as the intermediate head test tool) which is secured inside the stack for use in pressure-integrity testing as described above with reference to FIG. 5. As explained, bull-nosed bottom portion 101 which has an annular shoulder for supporting above it a metal gauge ring 102, an elastomeric backup seal 103 and an elastomeric cup 104, which is preferably made of nitrile rubber, although other elastomers or polymers may be used. The cup 104 includes a pair of annular grooves **104*a* into which O-rings may be seated to provide a fluid-tight seal between the cup 104 and the bull-nosed bottom portion 101. The test plug 100 further includes a tubular extension 105 which is threaded at a bottom end to support the bull-nosed end portion 101. A top end of the tubular extension 105 is integrally formed with an upper shoulder 106. The upper shoulder 106 abuts an annular constriction in the drilling flange 40 as shown. When the upper shoulder 106 has abutted the annular constriction, the locking pins 46 in the drilling flange 40 are screwed inwardly to engage an upper surface of the upper shoulder 106, thereby securing the test plug inside the stack. The upper shoulder 106 further includes a plurality of fluid passages 107** through which fluid may flow during pressurization of the stack.

The B section test plug 100 is inserted and retracted using the test plug landing tool 59, which is threaded to the test plug 100 inside an internally threaded socket 108, which extends upwardly from the upper shoulder 106, as described above. After the test plug landing tool 109 has been removed, the stack is pressurized to at least an estimated operating pressure. Due to the design of the B section test plug 100, the pressure-integrity of the joint between the intermediate casing and the intermediate casing mandrel (as well as the pressure-integrity of all the joints and seals above it in the stack) are pressure tested.

A typical test procedure begins with shutting the BOP pipe rams for testing of the pipe rams to the estimated operating pressure. The B section test plug 100 is then locked with the locking pins 46 and the landing tool 59 is removed. The BOP blind rams are then shut and tested to the estimated operating pressure. After a satisfactory test, the blind rams are opened and the landing tool is reinstalled. Finally, if all seals and joints are observed to withstand the estimated operating pressure, the locking pins 46 are released and the B section test plug 100 is removed.

Figure 10:
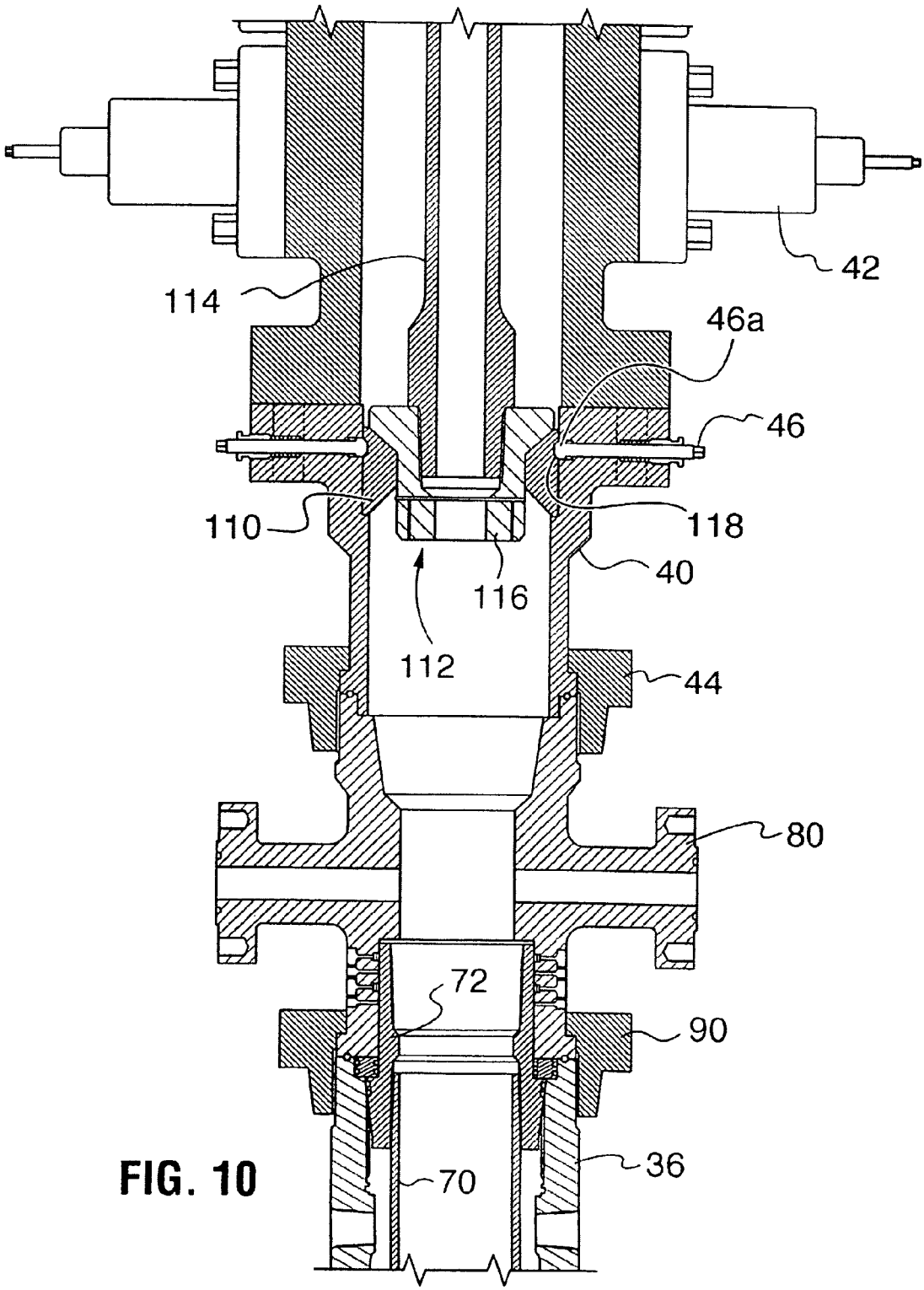
FIG. 10 is a cross-sectional elevational view of another drill bushing locked in place in the drilling flange.

FIG. 10 shows the installation of an intermediate wear bushing 110 in the drilling flange 40. The intermediate wear bushing 110 is installed using an insertion tool 112, which is very similar to the insertion tool 62 described above with reference to FIG. 6. The insertion tool 112 includes a landing joint 114, which is used to insert the intermediate wear bushing 110 to the correct location inside the drilling flange 40. The insertion tool 112 also has a bushing holder 116 threadedly connected to a bottom end of the landing joint 114 for holding the intermediate wear bushing 110. The intermediate wear bushing 110 is aligned with the drilling flange 40 and is then locked in place by the locking pins 46. A head **46*a* of each locking pin 46 engages an annular groove 118 in the wear bushing thereby locking the intermediate wear bushing 110** in place.

Once the intermediate wear bushing 110 is locked into place, the insertion tool 112 is retracted, leaving the wear bushing 110 locked inside the drilling flange 40. The stack is thus ready for drilling operations. A drill string (not shown) is run into the stack and rotates within the intermediate wear bushing, as described above.

Figure 11:
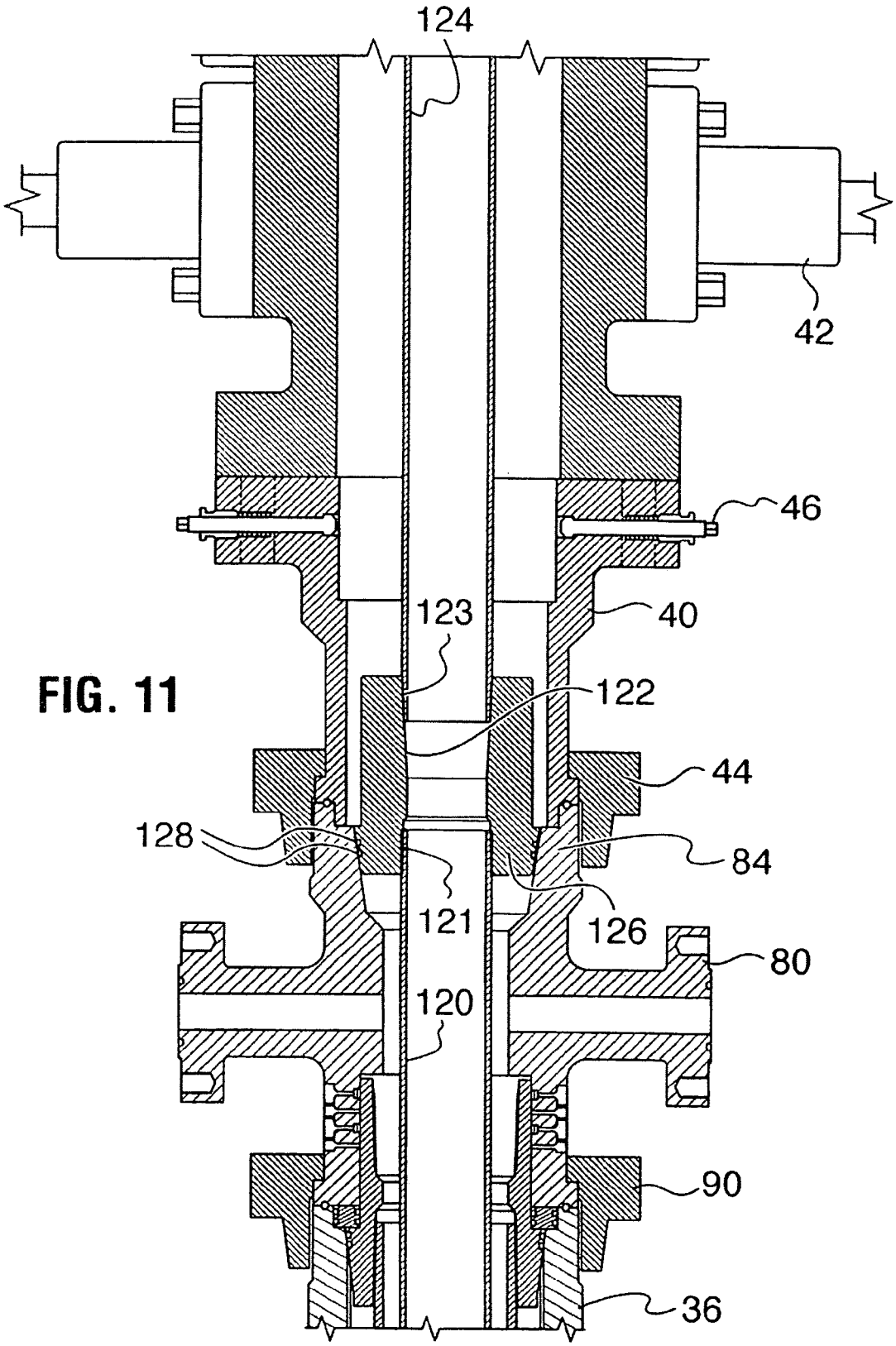
FIG. 11 is a cross-sectional elevational view of a production casing being run through the stack until a production casing mandrel is landed in the intermediate head spool.

After the desired bore is drilled, the drill string and associated collars and wear bushing are removed from the stack. As shown in FIG. 11, a production casing string 120 is then run and a production casing mandrel 122 is staged for cementing.

FIG. 11 illustrates how, after cement is run, the production casing mandrel 122 is landed onto the B section, or intermediate head spool 80, using a landing tool 124. The production casing mandrel 122 is secured by a box thread 121 to the production casing 120. The production casing mandrel 122 is secured to the landing tool 124 by a box thread 123. The production casing mandrel 122 has a frusta-conical bottom end 126 that sits in the bowl-shaped seat 84 of the intermediate head spool 80. The frusta-conical bottom end 126 has a pair of annular grooves 128 in which O-rings are received for providing a fluid-tight seal between the production casing mandrel 122 and the intermediate head spool 80.

Figure 12:
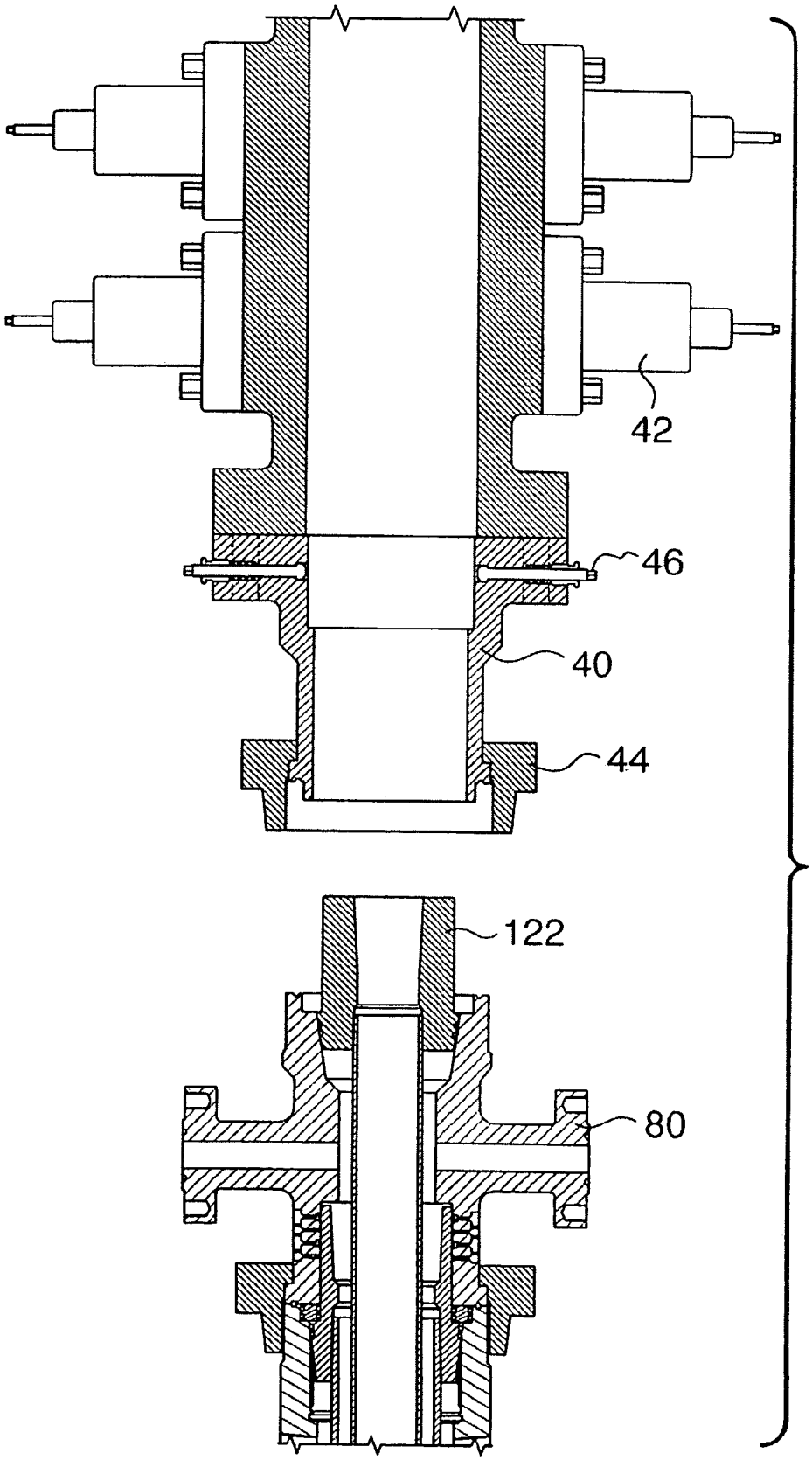
FIG. 12 is a cross-sectional elevational view depicting the removal of the blowout preventer and drilling flange from the intermediate head spool.

After the production casing mandrel 122 is landed in the intermediate head spool 80, the landing tool 124 is disconnected from the production casing mandrel and removed. Next, the drilling flange 40 and the blowout preventer 42 are removed as a unit (along with the threaded union 44) as illustrated in FIG. 12. The production casing mandrel 122 sits exposed atop the remainder of the stack.

Figure 13:
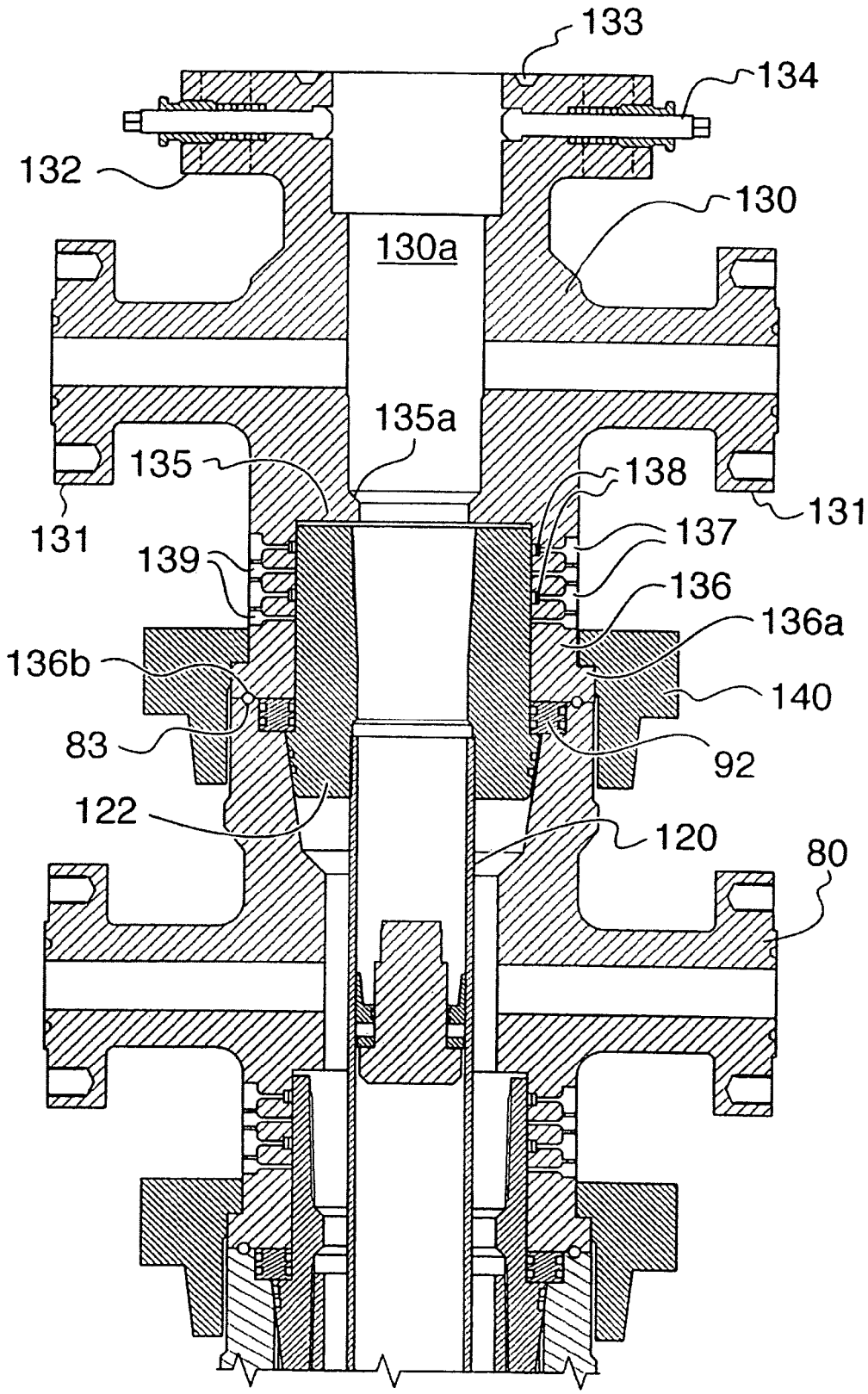
FIG. 13 is a cross-sectional elevational view of a tubing head spool secured by a nut to the intermediate head spool.

FIG. 13 depicts a tubing head spool 130 secured by a lockdown nut 140 to the intermediate head spool 80. The tubing head spool 130 includes a pair of flanged side ports 131 and a top flange 132. The top flange 132 has an annular groove 133 for receiving a standard metal ring gasket (not shown), which is well known in the art. The top flange 132 also has transverse bores for housing locking pins 134. The tubing head spool 130 has a stepped central bore 130*a*.

As shown in FIG. 13, the tubing head spool 130 further includes a inner shoulder 135 which has a bowl-shaped seat 135*a*. The inner shoulder 135 abuts a top surface of the production casing mandrel 122. Below the inner shoulder 135 is a bottom annulus 136, which includes an outer shoulder 136*a* that is engaged by the threaded union 140 when the threaded union 140 is tightened. Beneath the outer shoulder 136*a* is an annular groove 136*b* which aligns with the matching annular groove 83 in a top of the intermediate head spool 80. As shown in FIG. 13, the outer shoulder 136*a* abuts the top surfaces of the seal ring 92 and the intermediate head spool 80. A metal ring gasket is seated in the annular grooves 136*b*, 83. The metal ring gasket is described in detail in Applicant's co-pending application referenced above.

The bottom annulus 136 has two injection ports 137 through which two plastic injection seals 138 are injected. The bottom annulus 136 also has a pair of test ports 139 for use in pressure-integrity testing.

Figure 14:
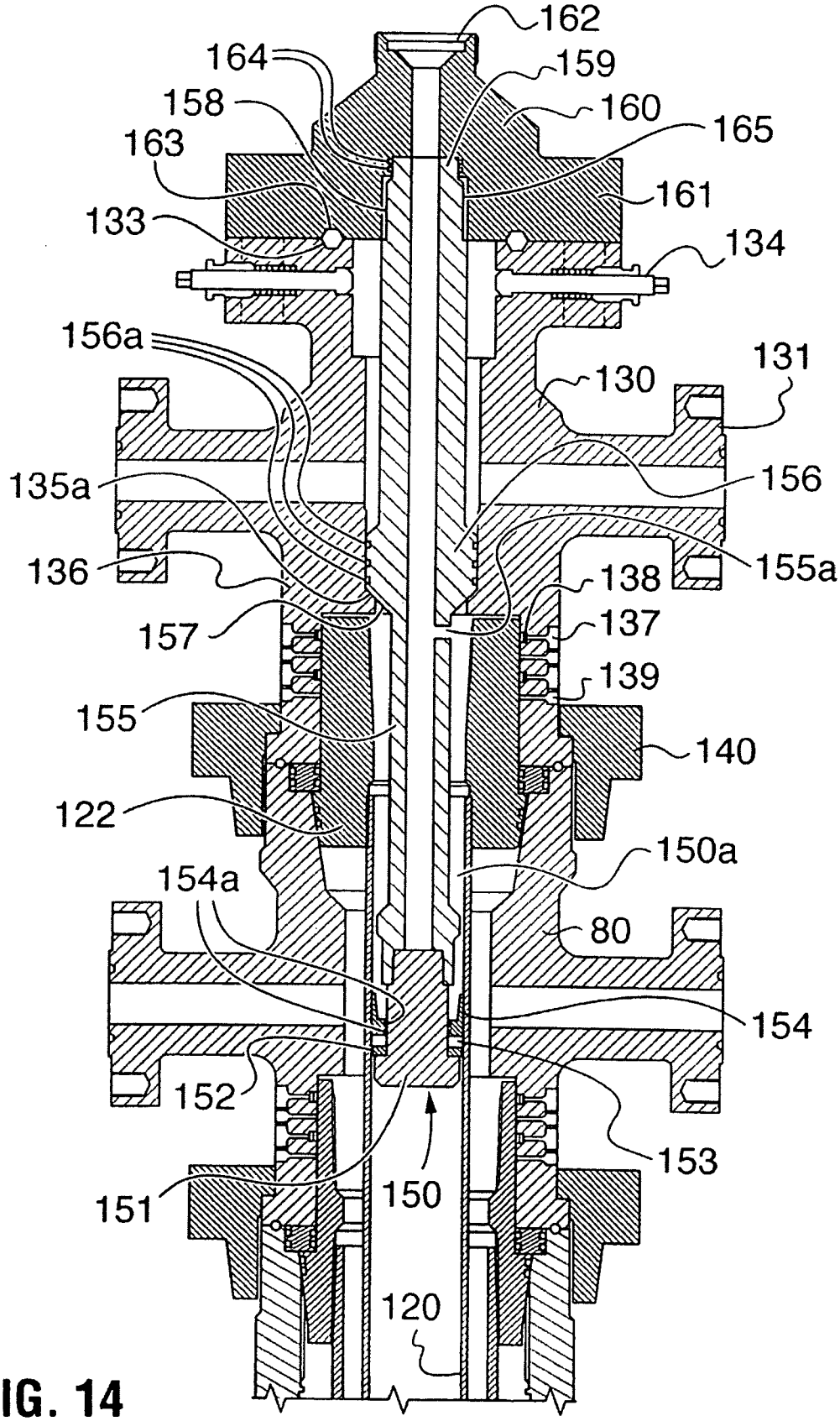
FIG. 14 is a cross-sectional elevational view of a tubing head pressure test tool inserted into the production casing for pressure-integrity testing.

FIG. 14 illustrates a tubing head test plug 150 installed inside the bore of the stack for pressure-integrity testing. Landed in the position shown, the test plug 150 permits pressure-integrity testing of the joint between the production casing 120 and the production casing mandrel 122, as well as all the joints and seals above that joint.

The test plug 150 has a solid bull-nosed end piece 151 which has an upper annular shoulder upon which is supported a metal gauge ring 152, an elastomeric backup seal 153, and an elastomeric cup 154. The gauge ring 152, backup seal 153 and cup 154 provide a fluid-tight seal between the test plug 150 and the production casing 120. The cup 154 includes two annular grooves 154*a* in which O-rings may be seated for providing a fluid-tight seal between the bull-nosed end piece 151 and the cup 154. At an upper portion of the bull-nosed end piece are threads for connecting to a tubular extension 155. The tubular extension 155 has an opening 155*a* through which pressurized fluid flows during pressurization of the stack. The tubular extension has a flared section 156 with three O-ring grooves 156*a*. The flared section 156 has a lower beveled shoulder 157 which sits in the bowl-shaped seat 135*a* of the tubing head spool 130. A top end of the tubular extension 155 has a pin thread 158 and a sealing end section 159 for sealed connection to a Bowen union 160.

The Bowen union 160 includes a bottom flange 161, a Bowen adapter 162, and a ring gasket groove 163 which aligns with the annular groove 133 in the tubing head spool 130 for receiving a standard metal ring gasket. The Bowen union 160 further includes a pair of annular grooves 164 in which O-rings are seated for providing a fluid-tight seal between the Bowen union 160 and the sealing end section 159 of the tubular extension 155. The Bowen union 160 further includes a set of box threads 165 for engaging the threads 158 on the tubular extension 155.

For pressure-integrity testing of the stack, the Bowen union 160 is connected to a high-pressure line (which is not shown, but is well known in the art). Pressurized fluid is pumped through the central bore of the stack, through the opening 155*a* in the tubular extension 155 and into the annular space 150*a* between the tubular extension 155 and the production casing mandrel 122 and production casing 120.

After the pressure-integrity testing has been satisfactorily completed, the high-pressure line is disconnected from the Bowen union 160 and the test plug 150 and Bowen union 160 are then removed from the stack. The hybrid wellhead system is then ready for completion.

Figure 15:
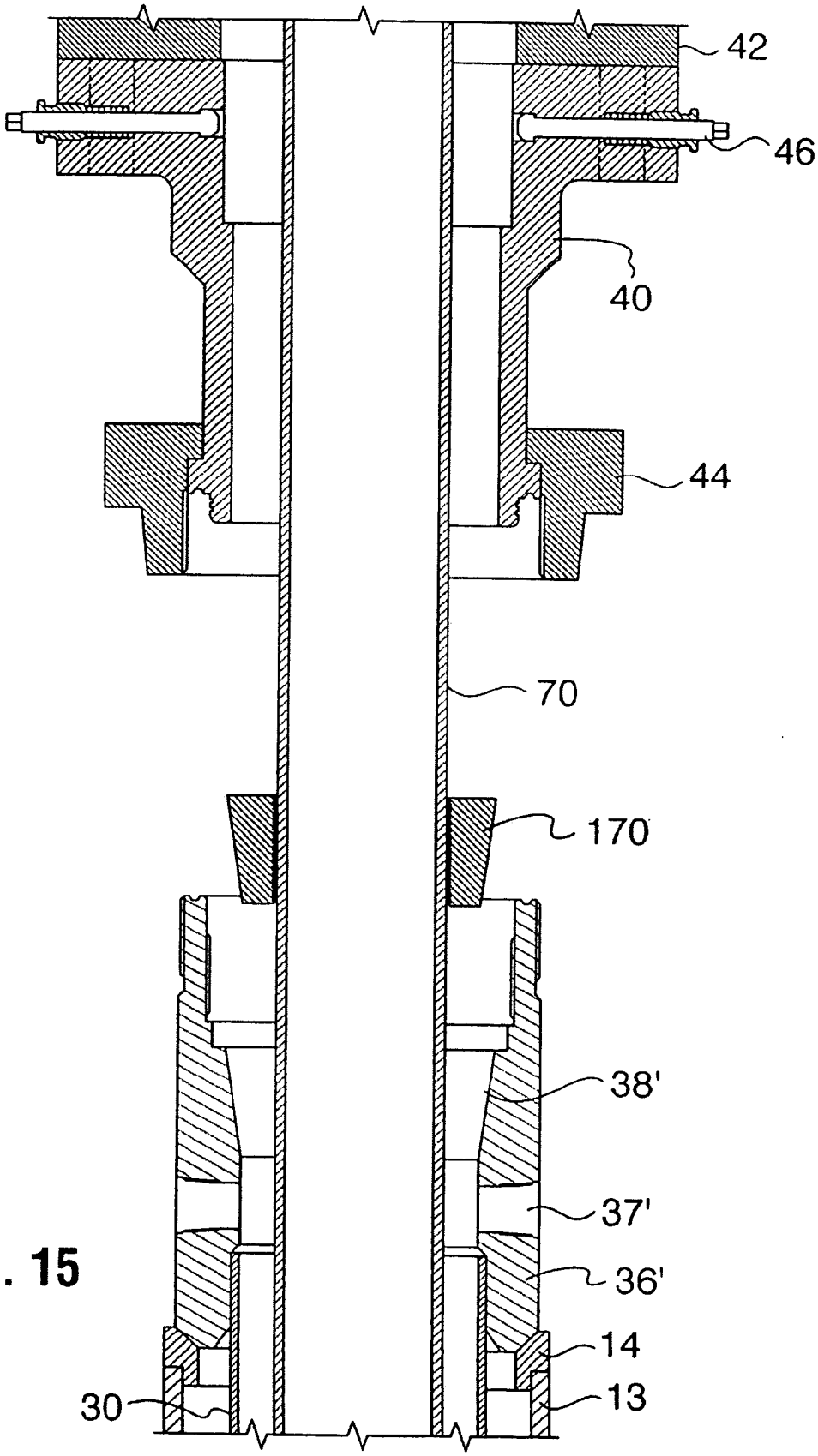
FIG. 15 is a cross-sectional elevational view of slips attached to the intermediate casing to be used where the intermediate casing cannot be run to its predicted depth.

In some cases, the intermediate casing string 70 cannot be run to the desired depth because of debris or some other blockage at or near the bottom of the well bore, or because the string length was miscalculated. In that case, slips 170 are affixed to the intermediate casing 70, as illustrated in FIG. 15. The slips 170 are frusta-conically shaped to be seated in an upwardly flared casing bowl 38' of a wellhead 36'. As shown, the wellhead 36' is a variant of the wellhead 36. The wellhead 36' has a modified casing bowl 38', i.e., the casing bowl 38' provides more angle with respect to the vertical and has a longer contact surface than the standard casing bowl 38. The casing bowl 38' is thus designed to support a tubular string using the slips 170. The casing bowl 38' includes side ports 37'.

Ordinarily, if the intermediate casing 70 can be fully run to the desired depth, the drilling flange 40 and the BOP 42 remain installed while the intermediate casing mandrel 72 is landed, as was shown in FIG. 7. However, as shown in FIG. 15, to permit the attachment of the slips 170, it is necessary to remove the drilling flange 40 and the BOP 42.

Figure 16:
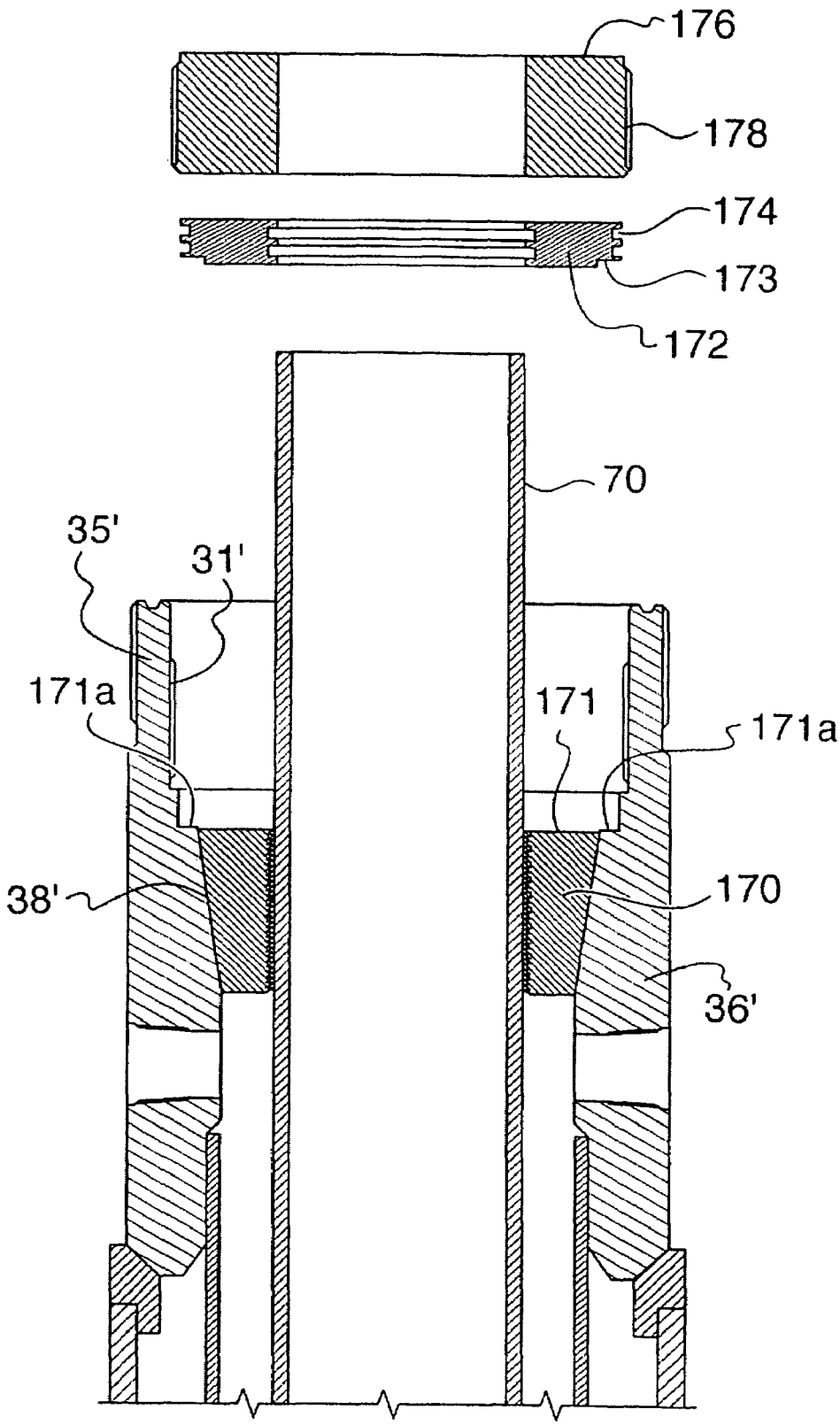
FIG. 16 is a cross-sectional elevational view of the slips seated in the casing bowl of the wellhead, showing a packing nut which is used to secure a seal plate on top of the slips.

As illustrated in FIG. 16, the slips 170 are seated in the casing bowl 38' of the wellhead 36'. The intermediate casing 70 is thus suspended in the well bore. An annular seal plate 172 having four annular grooves 174 for accommodating O-rings is seated on a top surface 171 of the slips 170 and on an annular ledge 171*a* of the wellhead 36'. As illustrated, the top surface 171 and the annular ledge 171*a* are not horizontally flush. Accordingly, the underside of the annular seal plate 172 has an annular recess 173 for accommodating the annular ledge 171*a*.

A packing nut 176 is secured atop the annular seal plate 172. The packing nut 176 has external threads 178, which engage internal threads 31' on an upper annular extension 35' of the wellhead 36'. The upper annular extension 35' also has external threads for meshing with a lockdown nut as will be described below.

Figure 17:
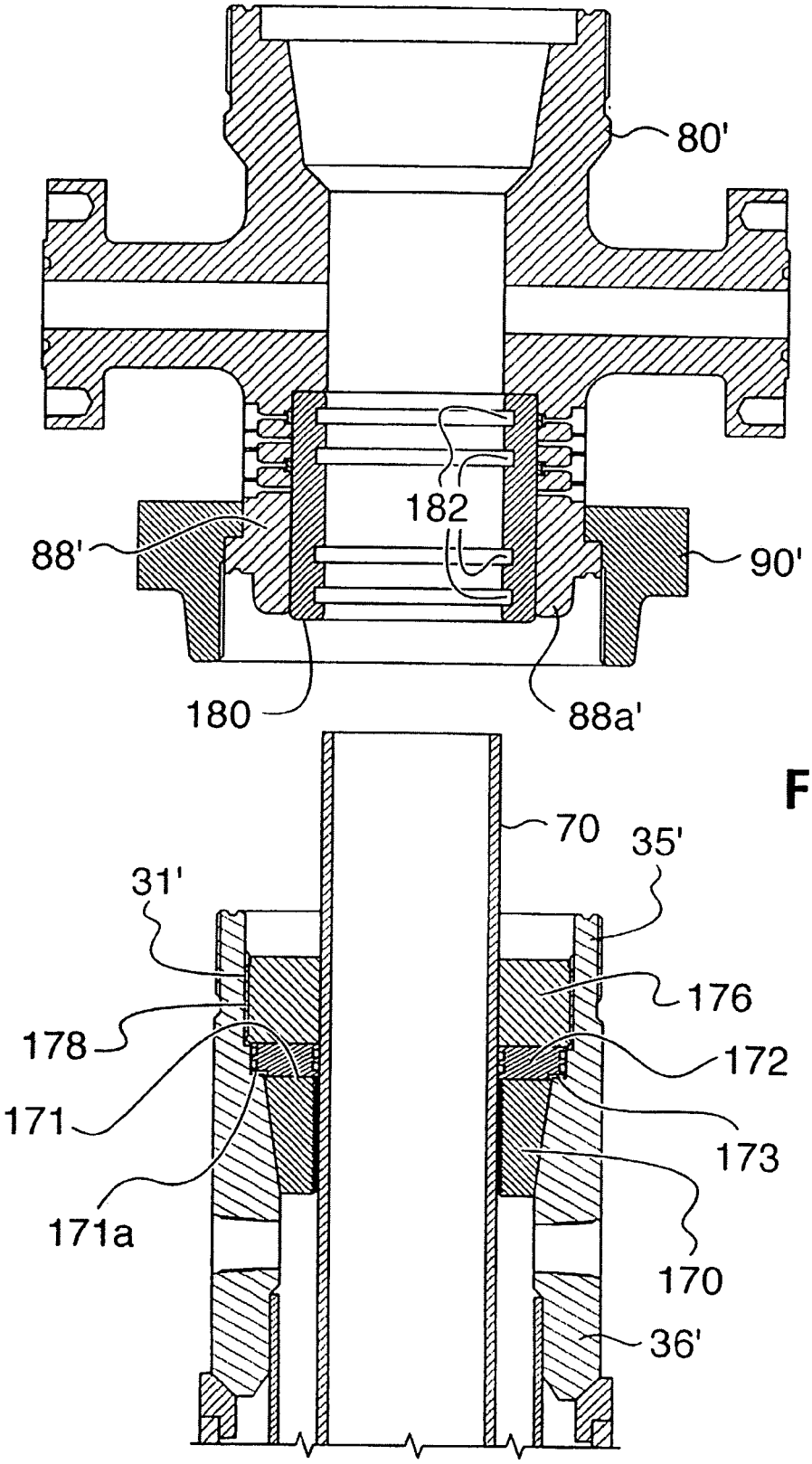
FIG. 17 is a cross-sectional elevational view showing an intermediate head spool and drop sleeve being lowered onto the packing nut and wellhead.

As shown in FIG. 17, an intermediate head spool 80' (also known as a B section) is installed atop the wellhead 36' and the packing nut 176. The intermediate head spool 80' is almost identical to the intermediate head spool 80 shown in FIGS. 8-14 except for the lower annular shoulder 88' which further includes a lower annular protrusion 88*a'* to accommodate the upper annular extension 35' of the wellhead 36'.

As illustrated in FIG. 17, the intermediate head spool 80' is secured to the wellhead 36' by a threaded union 90'. A drop sleeve 180 is inserted as a spacer between the intermediate casing 70 and the intermediate head spool 80', backing against the plastic injection seals 86 and test ports 87. The drop sleeve 180 fits beneath an annular shoulder in the intermediate head spool and above the packing nut 176. The drop sleeve 180 has four annular grooves 182 in which O-rings are seated for providing a fluid-tight seal between the drop sleeve 180 and the intermediate casing 70.

Figure 18:
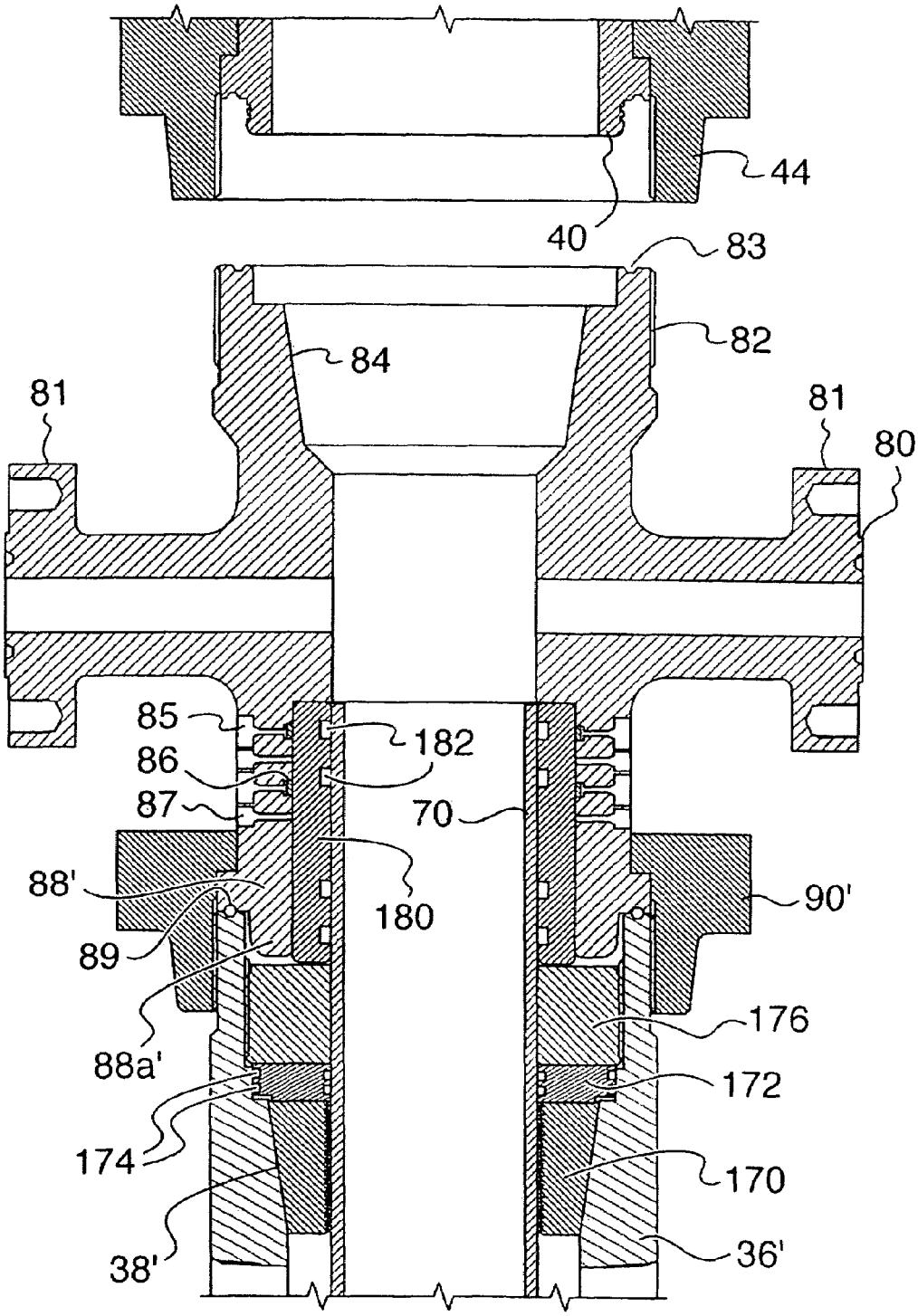
FIG. 18 is a cross-sectional elevational view of the intermediate head spool secured to the wellhead with a drop sleeve above the packing nut, seal plate and slips.

FIG. 18 illustrates the intermediate head spool 80' secured to the wellhead 36' by the threaded union 90'. The intermediate casing string 70 is secured and suspended in the well by the slips 170 which are seated in the casing bowl 38' of the wellhead 36'. The annular seal plate 172 (with O-rings in the grooves 174) provides a seal while the packing nut 176 secures the seal plate 172 and the slips 170 to the wellhead 36'. The drop sleeve 180 (with four O-rings in the grooves 182) acts as a spacer and seal between the intermediate head spool 80' and the intermediate casing 70, above the packing nut 176. As shown in FIG. 18, a drilling flange 40 (with a BOP mounted thereto, but not shown) is then secured to the intermediate head spool 80' using the threaded union 44. The threaded union 44 has a box thread that engages the upper pin thread 82 on the intermediate head spool 80'. A metal ring gasket is seated in the annular groove 83. Along with two adjacent O-rings, the metal ring gasket provides a fluid-tight seal between the drilling flange 40 and the intermediate head spool 80'.

Figure 19:
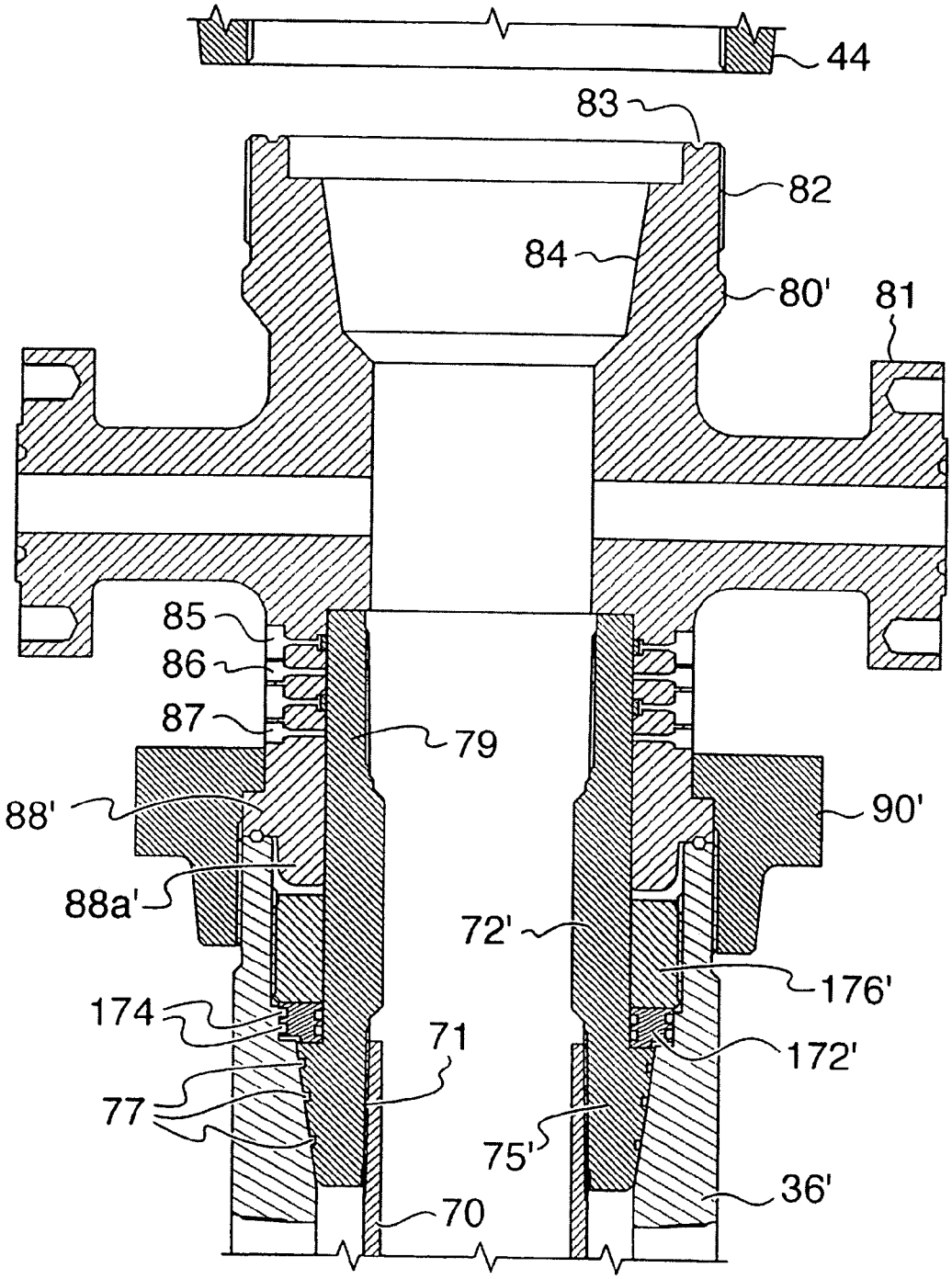
FIG. 19 is a cross-sectional elevational view of a second embodiment of the intermediate casing mandrel which has been elongated to replace the drop sleeve and the slips.

FIG. 19 illustrates a second embodiment of the intermediate casing mandrel 72' which is designed for use in conjunction with the wellhead 36'. The intermediate casing mandrel 72' has a box thread 71 for securing and suspending the intermediate casing 70 in the well. The intermediate casing mandrel 72' includes a frusta-conical bottom end 75' that is contained at the same level as the slips 170 shown in FIG. 18. The frusta-conical bottom end 75' has a larger contact surface with the wellhead 36', and is thus well suited for supporting a long intermediate casing string required in a particularly deep well.

As illustrated in FIG. 19, the frusta-conical bottom end 75' has three annular grooves 77 in which O-rings are seated to provide a fluid-tight seal between the intermediate casing mandrel 72' and the wellhead 36'. The intermediate casing mandrel 72' has a top end 79 that acts as a spacer, and replaces the drop sleeve 180 shown in FIG. 18. A thinner seal plate 172' and a thinner packing nut 176' accommodate the top end 79. The seal plate 172' also has four annular grooves 174 in which O-rings are seated to provide a fluid-tight seal between the intermediate casing mandrel 72' and the wellhead 36'. The plastic injection seals 85 also provide a fluid-tight seal with the top end 79 of the intermediate casing mandrel 72'.

The intermediate head spool 80' is secured by the threaded union 90' to the wellhead 36'. The intermediate head spool 80' abuts the top end 79 of the intermediate casing mandrel 72'. The outer shoulder 88' abuts the top of the wellhead 36'. The bottom annulus **88*a*' abuts the top of the packing nut 176'**.

Figure 20:
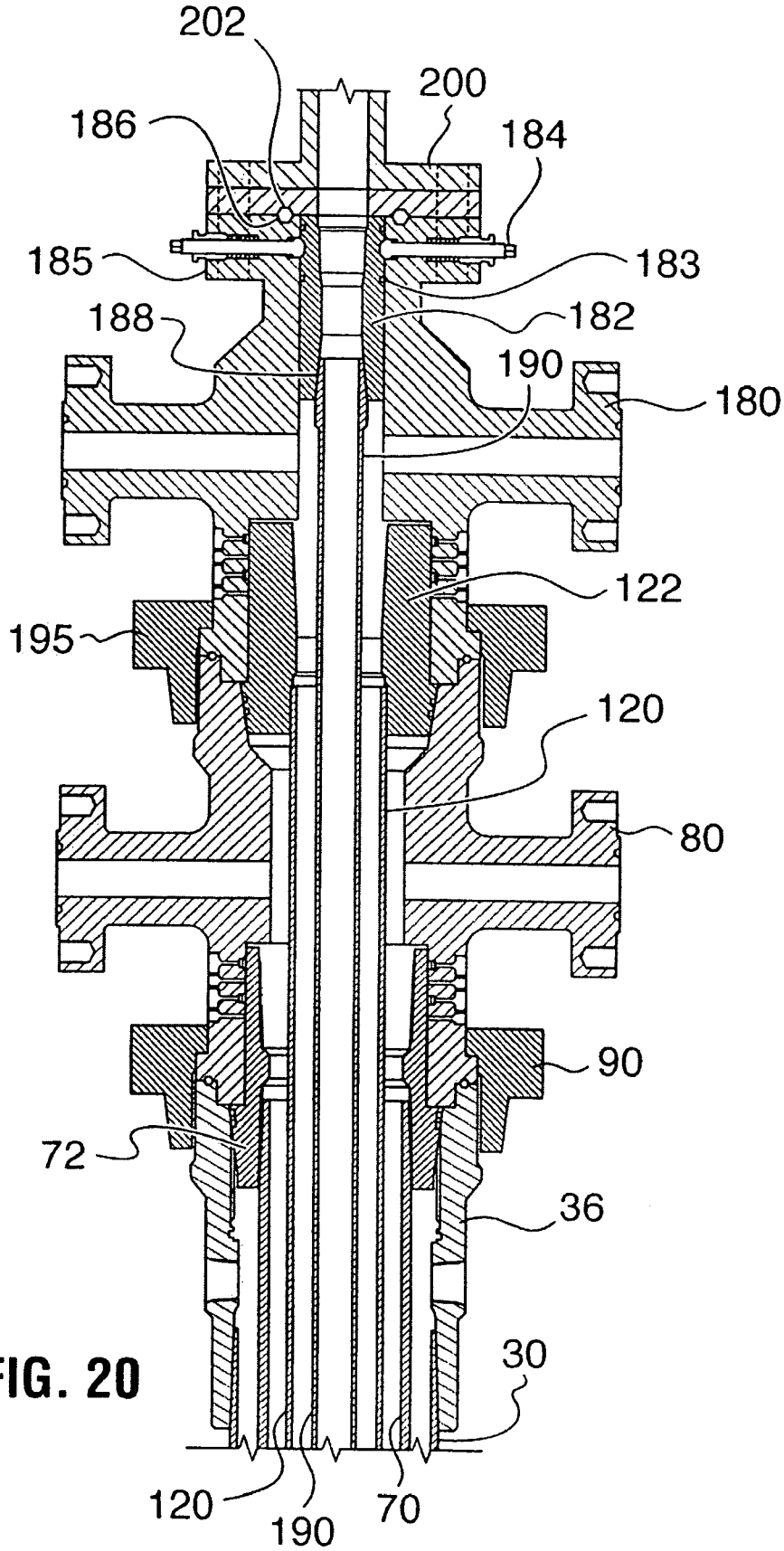
FIG. 20 is a cross-sectional elevational view of an assembled hybrid wellhead system showing a flow control stack flanged to the top of a tubing head spool, and threaded unions securing the tubing head spool to the intermediate head spool and securing the intermediate head spool to the wellhead.

FIG. 20 illustrates a completed hybrid wellhead system which includes wellhead 36, an intermediate head spool 80, a tubing head spool 180, and a flow-control stack 200. As illustrated and described above, the wellhead 36 is secured to the surface casing 30, the intermediate casing mandrel 72 is connected to the intermediate casing 70, and the production casing mandrel 122 is connected to the production casing 120. The tubing head spool 180 supports a tubing hanger 182 that is locked down by locking pins 184. The tubing hanger 182 has a box thread 188 for securing and supporting a production tubing string 190 within the production casing 120. The tubing head spool 180 is secured to the intermediate head spool 80 by a threaded union 195.

The flow-control stack 200 is flanged to a top flange 185 of the tubing head spool 180. The top flange 185 includes a ring gasket groove 186 which aligns with an annular groove 202 in the flow control stack 200 for receiving a standard metal ring gasket. The flow-control stack 200 may include any one or more of a flow tee, choke, master valve or production valves. These flow-control devices are well known in the art and are not described in further detail. The tubing hanger 182 also has a pair of annular grooves 183 in which O-rings are seated for providing a fluid-tight seal between the tubing head spool 180 and the tubing hanger 182.

FIG. 20 illustrates threaded unions for securing the intermediate head spool to the wellhead and for securing the tubing head spool to the intermediate head spool. A flanged connection is used for securing the flow-control stack to the tubing head spool, to permit a standard flow control stack to be used for hydrocarbon production. This hybrid wellhead system is capable of withstanding higher fluid pressures than independent screwed wellheads (which are typically rated at no more than 3000 PSI). The wellhead has a working pressure rating of 3000-5000 PSI. The intermediate head spool has a working pressure rating of 10,000 PSI. The tubing head spool has a working pressure rating of 10,000-15,000 PSI and higher working pressures can be accommodated, if required.

Persons skilled in the art will appreciate that other combinations of heads, fittings and components may be assembled in the manner described above to form a hybrid wellhead system. The embodiments of the invention described above are therefore intended to be exemplary only. The scope of the invention is intended to be limited solely by the scope of the appended claims.

We claim:

1. A hybrid wellhead system, comprising:

a plurality of tubular heads connected together using threaded unions to form the hybrid wellhead system, each tubular head supporting a tubing mandrel for suspending a respective tubular string in a well, each tubing mandrel having a top end that extends above a top of the tubular head that supports it; and a tubing head spool mounted to a top one of the tubular heads, the tubing head spool having a bottom end with an outer shoulder that is engaged by a threaded union for connecting the tubing head spool to the top one of the tubular heads, the tubing head spool supporting a tubing hanger that is locked in place and the tubing head spool further having a flanged top end for connection of a flow-control stack.

2. The hybrid wellhead system as claimed in claim 1 wherein a first of the tubular heads is a wellhead supported by a conductor nipple, and a second of the tubular heads is an intermediate head spool.

3. The hybrid wellhead system as claimed in claim 2 wherein the threaded unions are hammer unions.

4. The hybrid wellhead system as claimed in claim 2 wherein:

the wellhead is threadedly connected to a surface casing and supports an intermediate casing mandrel, the intermediate casing mandrel suspending an intermediate casing in the well; and the intermediate head spool supports a production casing mandrel, the production casing mandrel suspending a production casing in the well.

5. The hybrid wellhead system as claimed in claim 4 wherein the intermediate casing mandrel comprises a conical bottom end received in a casing bowl of the wellhead.

6. The hybrid wellhead system as claimed in claim 5 wherein a shoulder of the intermediate head spool locks down the intermediate casing mandrel.

7. The hybrid wellhead system as claimed in claim 6 wherein the intermediate casing mandrel further comprises a frusta-conical bottom end having a plurality of outward-facing annular grooves for receiving O-rings for forming a fluid-tight seal with the casing bowl of the wellhead.

8. The hybrid wellhead system as claimed in claim 4 further comprising an annular seal plate having a plurality of annular grooves therein for receiving O-rings, the annular seal plate being received between the intermediate casing mandrel and the wellhead.

9. The hybrid wellhead system as claimed in claim 8 further comprising a packing nut threadedly connected to the wellhead for locking down the annular seal plate.

10. The hybrid wellhead system as claimed in claim 4 wherein the intermediate head spool further comprises plastic injection seal ports for injecting plastic seals between the intermediate head spool and the intermediate casing mandrel.

11. The hybrid wellhead system as claimed in claim 10 wherein the intermediate head spool further comprises as test port used in pressure-integrity testing of the plastic seals.

12. The hybrid wellhead system as claimed in claim 4 wherein:

the intermediate head spool supports a tubing head spool that locks down the production casing mandrel; and the tubing head spool supports a production tubing mandrel that suspends a production tubing in the well.

13. The hybrid wellhead system as claimed in claim 12 further comprising an annular seal plate having a plurality of annular grooves therein for receiving O-rings, the annular seal plate being received between the production casing mandrel and the intermediate head spool.

14. The hybrid wellhead system as claimed in claim 12 wherein the tubing head spool further comprises plastic injection seal ports for injecting plastic seals between the tubing head spool and the production casing mandrel.

15. The hybrid wellhead system as claimed in claim 14 wherein the tubing head spool further comprises test ports used in pressure-integrity testing of the plastic seals.

16. A method of installing a wellhead for stimulating a well for the extraction of hydrocarbons therefrom, where fluid pressure may exceed a working pressure rating of an independent screwed wellhead to be installed on the well, the method comprising:

securing a plurality of tubular heads together to form a hybrid wellhead system using threaded unions, each tubular head suspending a respective tubular string in the well, each of the successive tubular heads having a higher working pressure rating than a tubular head to which a bottom end of each respective tubular head is secured;

mounting a tubing head spool to a top one of the tubular heads, the tubing head spool having a bottom annulus which includes an outer shoulder that is engaged by a threaded union for connecting the tubing head spool to the top one of the tubular heads, the tubing head spool supporting a tubing hanger and having a flanged top end for connection of a flow-control stack.

17. The method as claimed in claim 16 further comprising securing a flow-control stack to the tubing head spool of the hybrid wellhead system using the flanged top end of the tubing head spool.

18. The method as claimed in claim 16 wherein securing the plurality of tubular heads comprises threadedly securing an intermediate head spool to the independent screwed wellhead.

19. The method as claimed in claim 16 wherein securing the respective tubular heads comprises securing each tubular head using a hammer union.

20. The method as claimed in claim 16 further comprising:

landing slips in a casing bowl of the hybrid wellhead system;

landing an annular seal plate over the slips; and locking down the seal plate using a packing nut.

21. The method as claimed in claim 20 further comprising landing a drop sleeve between the casing bowl and the intermediate head spool above the packing nut.

* * * * *